US007512370B2

(12) United States Patent
Shimizu et al.

(10) Patent No.: US 7,512,370 B2
(45) Date of Patent: Mar. 31, 2009

(54) IMAGE HEATING APPARATUS

(75) Inventors: Yuusuke Shimizu, Susono (JP); Keisuke Mochizuki, Susono (JP); Atsutoshi Ando, Yokohama (JP); Michio Uchida, Susono (JP); Tomoo Akizuki, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 245 days.

(21) Appl. No.: 11/623,913

(22) Filed: Jan. 17, 2007

(65) Prior Publication Data

US 2007/0116502 A1 May 24, 2007

Related U.S. Application Data

(63) Continuation of application No. PCT/JP2006/315245, filed on Jul. 26, 2006.

(30) Foreign Application Priority Data

Jul. 26, 2005 (JP) ..... 2005-216151
Jul. 25, 2006 (JP) ..... 2006-202136

(51) Int. Cl.
*G03G 15/20* (2006.01)

(52) U.S. Cl. ..... 399/329; 399/122

(58) Field of Classification Search ..... 399/67, 399/69, 107, 122, 328, 329; 219/619
See application file for complete search history.

(56) References Cited

U.S. PATENT DOCUMENTS 5,450,181 A * 9/1995 Tsukida et al. ..... 399/322
6,614,004 B2 9/2003 Moriya et al. ..... 219/216
6,763,205 B2 * 7/2004 Izawa et al. ..... 399/69
7,034,261 B2 * 4/2006 Suzuki ..... 219/619

FOREIGN PATENT DOCUMENTS

| | | |
|---|---|---|
| JP | 03-242668 | 10/1991 |
| JP | 5-127550 | 5/1993 |
| JP | 6-282200 | 10/1994 |
| JP | 8-314325 | 11/1996 |
| JP | 10-260599 | 9/1998 |
| JP | 2002-033177 | 1/2002 |

OTHER PUBLICATIONS

International Preliminary Report on Patentability for PCT Application No. PCT/JP2006/315245.

* cited by examiner

*Primary Examiner*—Hoan H Tran
(74) *Attorney, Agent, or Firm*—Fitzpatrick, Cella, Harper & Scinto

(57) ABSTRACT

When a fixing device becomes uncontrollable and a large amount of electric power is continuously supplied to the heater, concentration of mechanical stress on a heater is suppressed, whereby shear fracture of the heater is prevented from occurring. A longitudinal region of the heater in which a heat generation resistive member is provided is supported by a heater support surface of a heater holder, and an opposed surface of the heater holder that is opposed to a longitudinal region of the heater in which the heat generation resistive member is not provided is designed not to be in contact with the heater.

9 Claims, 17 Drawing Sheets

IMAGE HEATING APPARATUS

This application is a continuation of International Application No. PCT/JP2006/315245, filed Jul. 26, 2006, which claims the benefit of Japanese Patent Application Nos. 2005-216151, filed Jul. 26, 2005 and 2006-202136, filed Jul. 25, 2006.

BACKGROUND OF THE INVENTION

1. Field of the Invention

The present invention relates to an image heating apparatus that can be suitably used as a heat fixing device equipped in a copying machine and a printer, and more particularly to an image heating apparatus provided with a heater having a heat generation resistive member provided on a substrate and an elastic roller that forms, in cooperation with the heater, a nip portion through which a recording material that bears an image conveyed.

2. Description of the Related Art

As disclosed in Japanese Patent Application Laid-Open No. H06-282200, a film type fixing device has been practically used as a fixing device equipped in a copying machine or a printer. The film type fixing device has a heater made of a ceramic material, a fixing film made of a polyimide or stainless steel etc. whose inner circumference is in contact with the heater and a pressure roller that forms a fixing nip portion in cooperation with the heater with the fixing film between.

In a type of film type fixing device, an elastic layer made of a silicone rubber or the like is provided on the fixing film. The elastic layer provided on the fixing film makes it possible to fix a toner image on a recording material in a surrounding manner. For this reason, this type of fixing device is mainly used in a full color printer.

In recent years, a further increase in the speed of image forming apparatuses has been demanded. To increase the speed, it is necessary to give a larger quantity of heat to the recording material in a shorter time. This requires to supply a larger electric power to the heater to increase the overall quantity of heat generated.

In the case where electric power supplied to the heater is increased with a increase in the speed of image forming apparatuses or development of color image forming apparatuses, there arises a problem that cracking of the heater can occur when a fixing device becomes uncontrollable and a large amount of power is continuously supplied due to malfunction. The fixing device is equipped with a thermosensitive element (safety element) such as a thermostatic switch that shuts down power supply to the heater when the temperature of the heater rises excessively. Therefore, no problem arises if this element works immediately when an abnormal temperature rise of the heater occurs. However, when a large amount of power is supplied to the heater, the thermosensitive element sometimes cannot respond to rapid temperature rise of the heater, and delay in operation of the thermosensitive element occurs. When the operation of the thermosensitive element delays, cracking of the heater is likely to occur.

The principal cause of cracking of the heater is mechanical shear fracture. FIG. 4 shows cracks formed in a heater 149 made of a ceramic held in a heater holder made of a resin. When a large amount of power is continuously supplied to a heat generation resistive member 150 provided on a ceramic substrate of the heater 149 as shown in FIG. 4, the temperature of the heater 149 rises excessively. As a result, the temperature of the heater support surface of the heater holder that is in contact with the heater exceeds the allowable temperature limit, so that the support surface melts.

In addition, a pressing force is applied on the heater from the pressure roller, and the heater is pushed into the heater holder together with the heater support surface. On the other hand, the temperature of the area on the ceramic substrate in which the heat generation resistive member 150 is not provided does not rise so much even when a large amount of power is continuously supplied. Accordingly, melting of the heater support surface of the heater holder does not occur in this area, and therefore the heater is not pushed into the heater holder. Consequently, a step or a difference in level occurs at the boundary between the support surface (melting surface) 151 of the heater holder that supports the area of the heater in which the heat generation resistive member 150 is provided and the support surface 152 that supports the area of the heater in which the heat generation resistive member 150 is not provided. The presence of this level difference invites concentration of stress in the heater 149. As a result, shear fracture of the heater 149 occurs. If a thermosensitive element such as a thermostatic switch operates before the heater holder is softened, cracking of the heater can be prevented. However, if the operation of the thermosensitive element is delayed as described above, cracking of the heater cannot be avoided.

When cracking of the heater occurs, the heater cannot be used any longer. This is disadvantageous from the viewpoint of recycling of parts. In addition, there is the problem that a sufficient distance cannot be left between a portion to which the primary voltage is applied via a thermistor or the like provided on the heater and the secondary circuit or the ground portion. This sometimes leads to breakage of the secondary circuit, and an additional repair cost may be incurred.

SUMMARY OF THE INVENTION

To solve the above described problems, according to the present invention, there is provided an image heating apparatus comprising a heater having a substrate, a heat generation resistive member provided on said substrate and an electrode provided on said substrate for supplying electric power to said heat generation resistive member, a holder made of a resin that has a connector attachment portion provided at an end portion thereof with respect to a longitudinal direction for attaching a power feeding connector to be connected to said electrode, said holder holding said heater all along its longitudinal direction, and an elastic roller that forms a nip portion in cooperation with said heater, the image heating apparatus heating an image formed on a recording material by said nip portion, wherein said heat generation resistive member of said heater is arranged within the area of said nip portion with respect to the longitudinal direction of said heater, said connector attachment portion of said holder is arranged outside the area of said nip portion, and a surface of said holder that is opposed to a surface of said heater that is opposite to the nip portion side surface thereof includes a seating area that is in contact with said heater and a concaved portion area that is located closer to an end with respect to said longitudinal direction than said seating area is and is not in contact with said heater all along the shorter side of said heater.

With the present invention, it is possible to suppress cracking of the heater.

Further features of the present invention will become apparent from the following description of exemplary embodiments with reference to the attached drawings.

DESCRIPTION OF THE EMBODIMENTS

First Embodiment (Description of Structure of Image Forming Apparatus)

Figure 8:
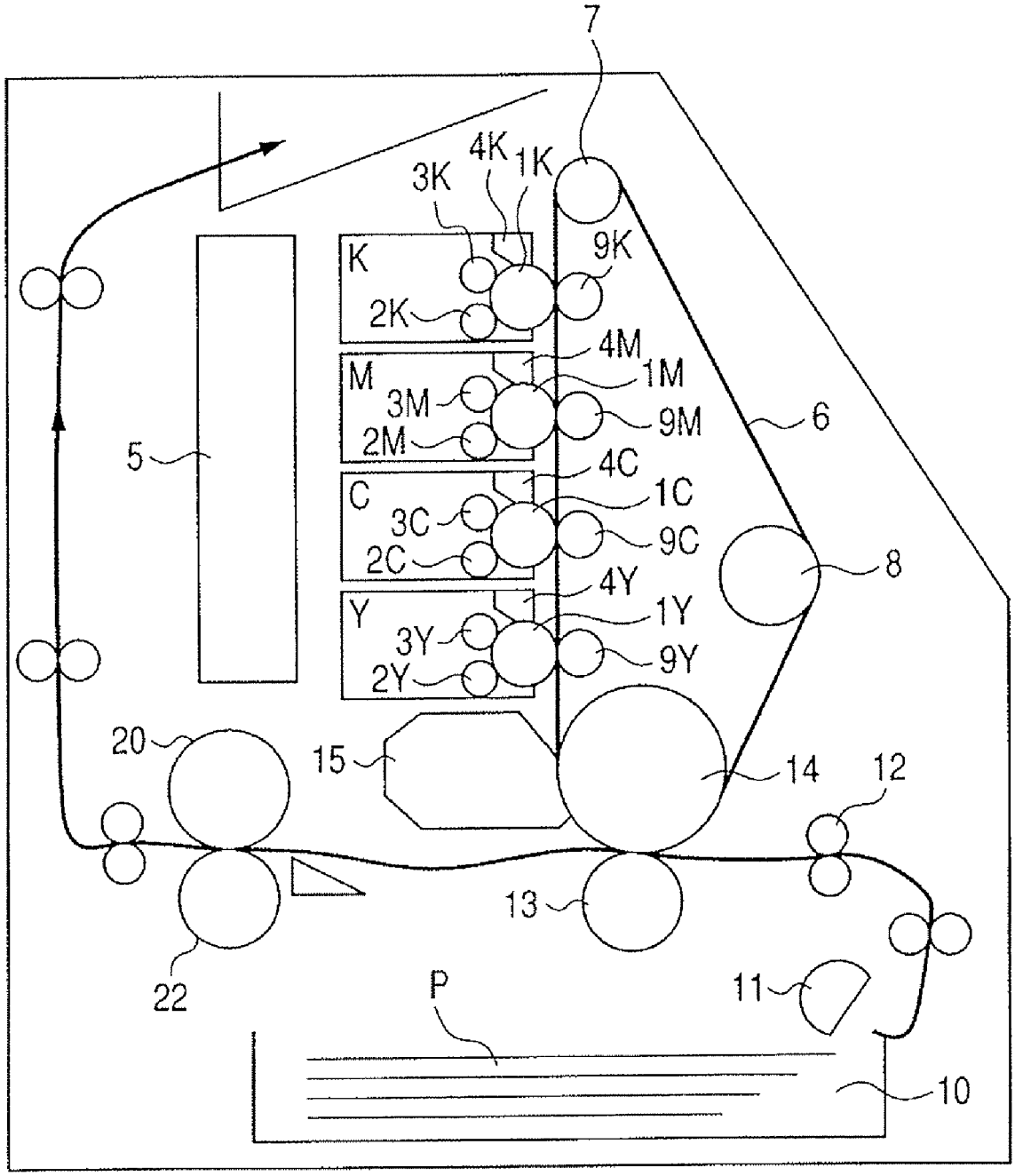
FIG. 8 is a schematic cross sectional view of an image forming apparatus.

FIG. 8 is a schematic cross sectional view of an image forming apparatus equipped with a fixing device according to this embodiment. The image forming apparatus according to this embodiment delivers full color images by superposing toner images of four colors (yellow, cyan, magenta and black) using an electrophotography process. The process speed of the image forming apparatus according to this embodiment is 122 mm/sec, and it can print on twenty-two (22) US letter size sheets per minute. The time took until the first page out (FPOT) is approximately 13 seconds. The image forming apparatus according to this embodiment uses four so-called all-in-one cartridges in each of which a photosensitive drum (1Y, 1C, 1M, 1K), a charging roller (2Y, 2C, 2M, 2K), a developing roller (3Y, 3C, 3M, 3K) for developing an electrostatic latent image into a visible image, a photosensitive drum cleaning blade (4Y, 4C, 4M, 4K) and other parts are integrated in a single housing. More specifically, it uses a yellow cartridge having a developing device filled with yellow (Y) toner, a magenta cartridge having a developing device filled with magenta (M) toner, a cyan cartridge having a developing device filled with a cyan (C) toner and a black cartridge having a developing device filled with black (K) toner. In the image forming apparatus according to this embodiment is provided an optical system 5 for forming electrostatic latent images on the photosensitive drums (1Y, 1C, 1M, 1K) through exposure for the above described four color toner cartridges. The optical system used herein is a laser scanning exposure optical system.

The photosensitive drum (1Y, 1C, 1M, 1K) charged by the charging roller (2Y, 2C, 2M 2K) is exposed to a scanning light beam that is emitted from the optical system 5 based on image data, so that an electrostatic latent image corresponding to the image data is formed on the surface of the photosensitive drum (1Y, 1C, 1M, 1K). The developing bias applied to the developing roller (3Y, 3C, 3M, 3K) by a bias voltage source (not shown) is adjusted to an appropriate value between the charge potential and the potential of the exposed portion. Consequently, negatively charged toner adheres to the electrostatic latent image formed on the photosensitive drum (1Y, 1C, 1M, 1K), namely the image is developed. A single color toner image developed on the photosensitive drum (1Y, 1C, 1M, 1K) is transferred onto an intermediate transferring member 6 that is rotated at a substantially constant speed in synchronization with the photosensitive drum (1Y, 1C, 1M, 1K). The intermediate transfer member used in this embodiment is an intermediate transfer belt 6, which is driven by a driving roller 7 and wound on a tension roller 8. The toner image on the photosensitive drum (1Y, 1C, 1M, 1K) is transferred onto the intermediate transfer belt 6. A primary transfer roller (9Y, 9C, 9M, 9K) is used as primary transfer means. By applying a primary transfer bias with the polarity opposite to that of the toner to the primary transfer roller (9Y, 9C, 9M, 9K) using a bias voltage source (not shown), the toner image is primarily transferred from the photosensitive drum to the intermediate transfer belt 6. After the primary transfer, the toner remaining on the photosensitive drum (1Y, 1C, 1M, 1K) is removed by the cleaning blade (4Y, 4C, 4M, 4K). The cleaning blade used in this embodiment is a urethane blade. The above described process is performed for each of the colors (yellow, magenta, cyan and black) in synchronization with the rotation of the intermediate transfer belt 6, so that primary toner images of the respective colors are sequentially formed in an superposed manner on the intermediate transfer belt 6. When an image of only a single color is to be formed (in the single color mode), the above described process is performed with only the intended color.

A recording material P set in a recording material cassette 10 serving as a recording material supply portion is fed by a feeding roller 11. After that, the recording material P is conveyed to the nip portion between the intermediate transfer belt 6 and the secondary transfer means from registration rollers 12 at predetermined timing. The primarily transferred toner images formed on the intermediate transfer belt 6 are transferred onto the recording material P at one time by a secondary transfer roller 13 serving as secondary transfer means. To the secondary transfer roller 13 is applied a bias with the polarity opposite to the polarity of the toner, by bias applying means that is not shown in the drawings. Reference numeral 14 designates a roller opposed to the secondary transfer roller. After the secondary transfer, toner remaining on the intermediate transfer belt 6 is removed by intermediate transfer belt cleaning means 15. In this embodiment, the cleaning of the intermediate transfer member is performed by an urethane blade similar to the cleaning means for the photosensitive drums. The toner image having been secondarily transferred on the recording material P is melted and fixed thereon, as it passes through a fixing device serving as fixing means, to constitute an output image of the image forming.

(Description of Structure of Heater)

Figure 5:
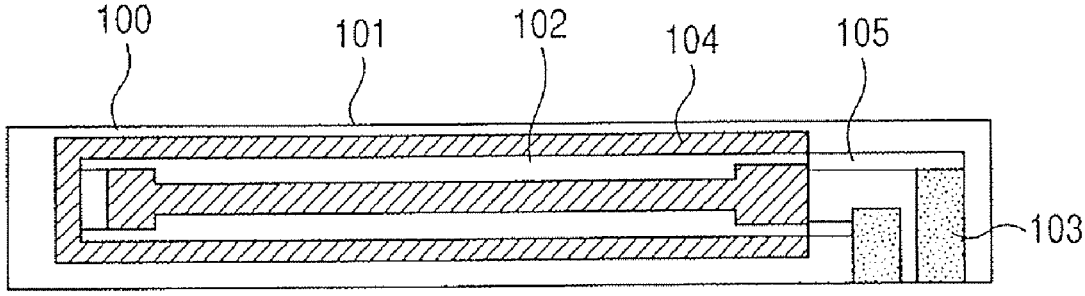
FIG. 5 is a top view of the heater used in the first embodiment.
Figure 6:
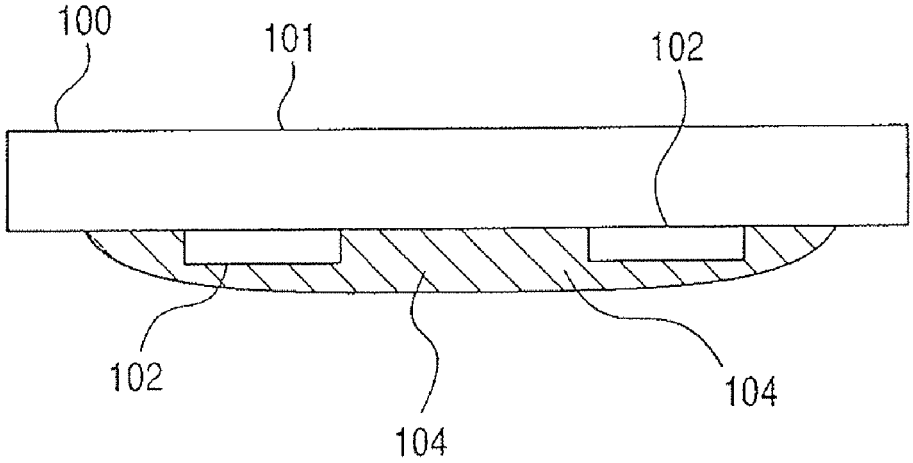
FIG. 6 is a cross sectional view of the heater shown in FIG. 5.

FIG. 5 is a top view of a heater 100 equipped in the fixing device according to the first embodiment of the present invention. FIG. 6 is a cross sectional view of the heater 100 on a plane perpendicular to the longitudinal direction thereof.

The heater 100 is mainly composed of a substrate 101, a heat generation resistive member 102, electrodes 103, insulation coating layer 104 and a conductor pattern 105. The substrate 101 may be a ceramic substrate made of an insulating ceramic such as alumina or aluminum nitride or a metal plate such as a stainless steel plate on which glass coating is applied to give insulating properties to it. The substrate used in this embodiment is an alumina substrate having a thickness of 1.0 mm, a length of 285 mm and a width of 7.5 mm.

The heat generation resistive member 102 may be formed by applying an electrically conductive paste on the substrate 101, or attaching a nichrome wire or the like on the substrate 101 using a known method such as adhesion. The heat generation resistive member is not needed to be provided directly on the substrate, but a glaze layer for preventing heat diffusion to the substrate may be provided between the substrate and the heat generation resistive member. In this embodiment, an electrically conductive paste containing silver-palladium alloy is applied on the alumina substrate 101 in a pattern shown in FIG. 5 by screen printing. The thickness of the applied paste is 20 μm. Thereafter it is subjected to firing to form the heat generation resistive layer 102. The value of resistance of the heat generation resistive member 102 used in this embodiment is 14Ω. Accordingly, the electric power consumption of the fixing heater 100 in the case where a voltage of 120 V is applied is 1029 W. The width of the central portion, with respect to the longitudinal direction, of the heat generation resistive member 102 is 1.5 mm, and there are two heat generation resistive members having the aforementioned width arranged in series. The distance between the two heat generation resistive members is 0.7 mm.

The end portions, with respect to the longitudinal direction, of the heat generation resistive member 102 has a width smaller than the other portions. When the width of the heat generation resistive member 102 is reduced, the resistance of the heat generation resistive member 102 is made larger in the reduced width portion, and the quantity of heat generated with the same current becomes larger accordingly. This compensates the heat carried away toward the longitudinal end portions through the substrate 101, so that a uniform temperature distribution is achieved along the longitudinal direction. In this embodiment, the width of the resistive member is reduced by 7% as compared to the other portions, namely the width of the reduced width portion of the resistive member is 1.395 mm.

The electrode 103 serves as an electric contact for allowing electric power supply to the heat generation resistive member 102 from the power source of the fixing device or the image forming apparatus. A terminal of a power feeding connector 301 is connected to this electrode 103. The electrode 103 in this embodiment is formed by applying a silver paste uniformly with a thickness of 20 μm by screen printing, in a manner similar to formation of the heat generation resistive member 102, and then firing it. The electrode 103 is formed at two positions on the substrate 101, each of which is connected to the heat generation resistive member 102. Thus, AC voltage is applied to the heat generation resistive member 102 through the electrodes 103.

The insulation coating layer 104 is formed using an insulating material such as a glass or resin in order to ensure a dielectric voltage of the heat generation resistive member 102 and the electrode 103. The insulation coating layer 104 in this embodiment is a coating layer of an insulating glass having a thickness of 80 μm formed by screen printing. The conductor pattern 105 is adapted to provide connection between the electrode 103 and the heat generation resistive member 102.

(Description of Structure of Fixing Device)

Figure 7:
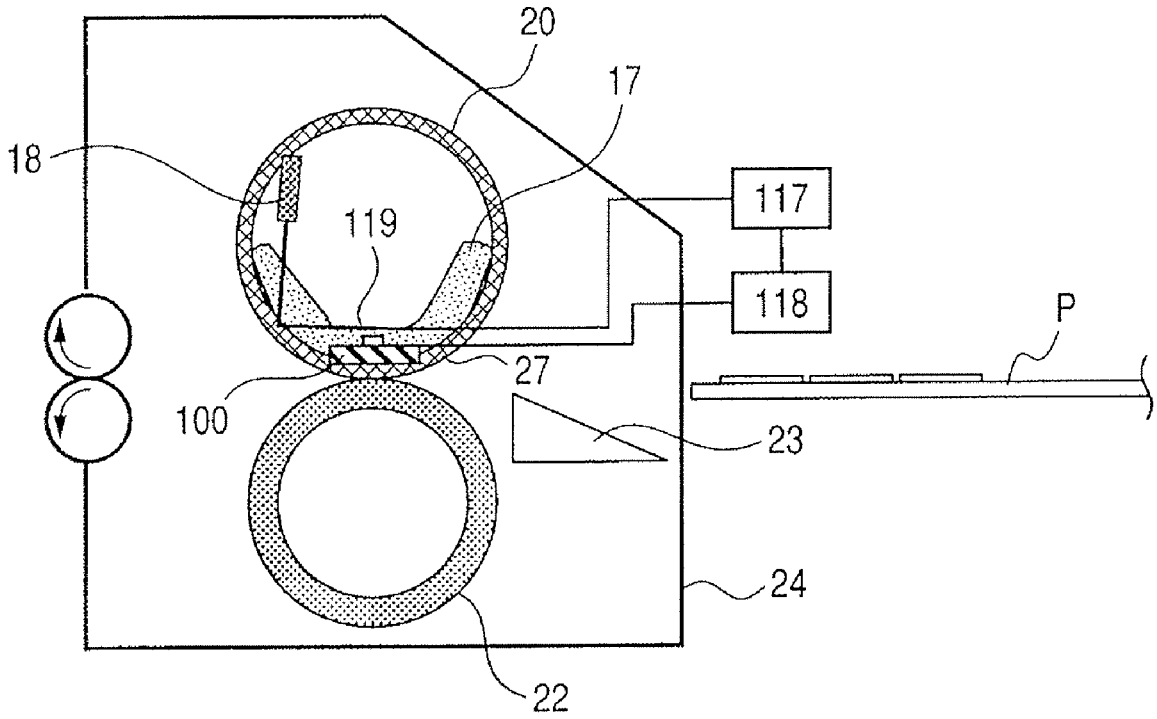
FIG. 7 is a cross sectional view of a fixing device according to the first embodiment.

FIG. 7 is a cross sectional view of the fixing device in this embodiment. The fixing device in this embodiment is mainly composed of a heater 100, a heater holder 17, a thermistor 18, a fixing belt (or flexible sleeve) 20, a pressure roller (or elastic roller) 22 and an entrance guide 23.

The heater holder 17 is made of a liquid crystal polymer resin having high heat-resisting properties and adapted to hold the heater 100 and guide the fixing belt 20. The liquid crystal polymer used in this embodiment is Zenite 7755M (registered trademark) sold by DuPont. The upper allowable temperature limit of Zenite 7755M is approximately 270° C. The thermistor 18 is provided to detect the temperature of the inner surface the fixing belt 20 and to control the temperature. The thermistor is constructed by attaching a thermistor element to an end of an arm made of a stainless steel. The arm swings to follow vibration of the fixing belt 20 upon rotation so that the thermistor element is always kept in contact with the inner surface of the fixing belt 20 even in the state in which the movement of the inner surface of the fixing belt 20 is unstable. The thermistor 18 is connected with a CPU 117. The CPU 117 is adapted to determine how to control the temperature of the heater 100 based on the output of the thermistor 18 and to control power supply from the power source 501 to the heater 100.

The fixing belt 20 has a base layer produced by drawing a base tube made of SUS (stainless steel) into a seamless belt shape with a thickness of 30 μm, a silicone rubber layer formed on the base layer by ring coating and a PFA resin tube layer with a thickness of 30 μm provided thereon. It is desired to use a material of the silicone rubber layer having as high a thermal conductivity as possible thereby making the heat capacity of the fixing belt 20 small. This makes it possible to raise the temperature of the fixing device quickly to temperatures allowing fixation. The material used in this embodiment has a thermal conductivity of $1.0\times10^{-3}$ cal/sec·cm·K, which is relatively high as the thermal conductivity of silicone rubbers. On the other hand, from the viewpoint of enhancing image quality in terms of overhead transparency and suppression of minute unevenness in gloss on the image, it is desired to make the thickness of the rubber layer of the fixing belt 20 as large as possible. It has been known from a study that to obtain satisfactory image quality, a rubber thickness of 200 μm or more is needed. The silicone rubber layer in this embodiment has a thickness of 270 μm. Furthermore, by providing a fluoroplastic layer on the surface of the fixing belt 20, it is possible to enhance surface releasability thereby making it possible to prevent offset phenomenon, which occurs when toner once adheres to the surface of the fixing belt 20 and then is transferred to the recording material P again.

By using a PFA tube as the fluoroplastic layer on the surface of the fixing belt 20, it is possible to form a uniform fluoroplastic layer more easily.

The pressure roller 22 is produced by forming on a stainless steal core a silicone rubber layer with a thickness of approximately 2 mm by injection molding and covering it with a PFA resin tube with a thickness of 40 μm. The entrance guide 23 is adapted to guide the recording material P in such a way that the recording material P getting out of the secondary transfer nip is precisely guided to the fixing nip portion. The entrance guide in this embodiment is made of poly phenylene sulfide (PPS) resin. The pressure roller 22 and the entrance guide 23 are respectively mounted on the frame 24, and the fixing belt 20 in which a fixing heater 100 supported on the heater holder 17 is provided is arranged above them. The fixing belt 20 is pressurized by a pressurizing mechanism (see FIG. 18 for the second embodiment) with a force of 22 kgf (215. 6 N) (i.e. 11 kgf (107.8 N) for each side). The pressurizing mechanism is provided with a pressurization canceling mechanism so that when clearing paper jam or other troubles, it is possible to cancel the pressurization to allow easy removal of the recording material P.

In the fixing device according to this embodiment, the fixing belt 20 is driven to rotate by the rotation of the pressure roller 22. The fixing device is constructed in such a way that When the fixing belt 20 is driven to rotate, the inner surface of the fixing belt 20 and the heater holder 17 slide relative to each other. Grease is applied on the inner surface of the fixing belt 20 to ensure sliding of the heater holder 17 and the inner surface of the fixing belt 20. In normal use, the passive rotation of the fixing belt 20 starts when the pressure roller 22 starts to rotate, and the temperature of the inner surface of the fixing belt 20 rises with a rise in the temperature of the heater 100.

The fixing device according to this embodiment is equipped with a thermostatic switch 119 functioning as a safety device provided on the backside of the heater 100. The thermostatic switch 119 is provided in order to prevent, when the fixing device becomes uncontrollable, breakage of the fixing apparatus that may be caused if power supply to the heater 100 is not stopped but continued. When the temperature of the heater 100 exceeds a predetermined temperature (i.e. when an abnormal temperature rise occurs), the heat activates the thermostatic switch to shut down power supply to the heater 100. The heater 100 and the pressure roller 22 form a nip portion with a fixing belt 20 between. A recording material P that bears an toner image is held in the nip portion and conveyed, whereby the toner image on the recording material P is heated and fixed on it.

(Description of Heater Holder)

Figure 1:
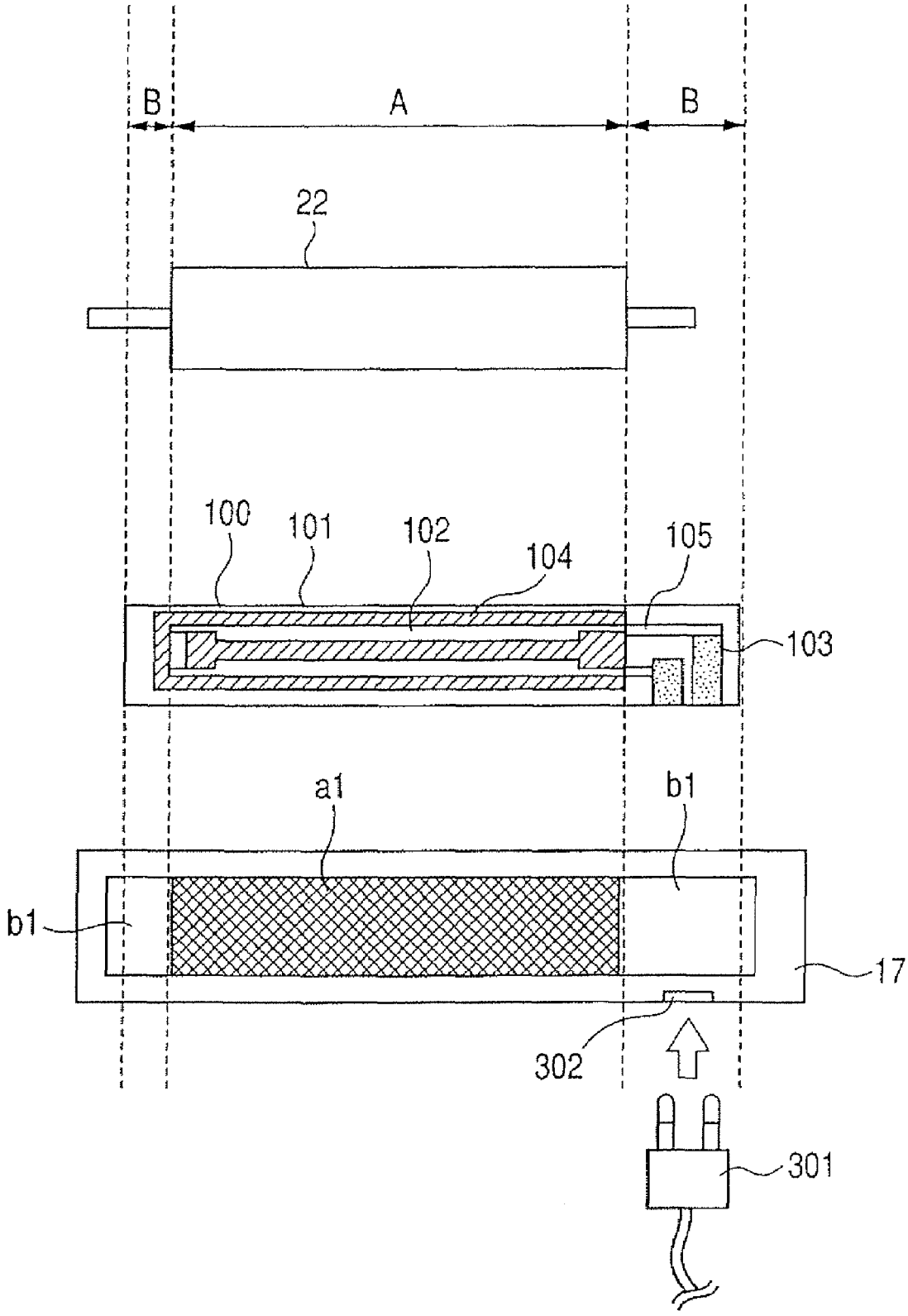
FIG. 1 illustrates the positional relationship along the longitudinal direction among a heater holder, a heater and a pressure roller in a first embodiment.

FIG. 1 shows relationship among the heater holder 17, the heater 100 and the pressure roller 22 along the longitudinal direction. The region indicated by sign A is the region in which the heat generation resistive member 102 is provided in the heater in this embodiment. Sign B indicates the other regions, namely the regions in which the heat generation resistive member 102 is not provided. The surface of the heater holder 17 that is designated by sign a1 is the support surface (seating surface) for the heat generation resistive member 102 region A of the heater 100. The surfaces of the heater holder 17 that are designated by sign b1 are the surfaces (convexed portion areas) that are opposed to the portions of the heater 100 in which the heat generation resistive member 102 is not provided.

In region B of the heater holder 17 is provided a connector attachment portion 302 to which a power feeding connector 301 to be connected to the electrodes 103 of the heater 100 is attached. In this embodiment, the length of the pressure roller 22 (i.e. the length of the nip portion), the length of the heat generation resistive member 102 and the length of the seating surface al are substantially equal to one another. In addition, the heat generation resistive member 102 of the heater 100 is arranged in the area of the fixing nip portion with respect to the longitudinal direction of the heater, while the connector attachment portion 302 of the heater holder 17 is arranged outside the area of the fixing nip portion.

Figure 2:
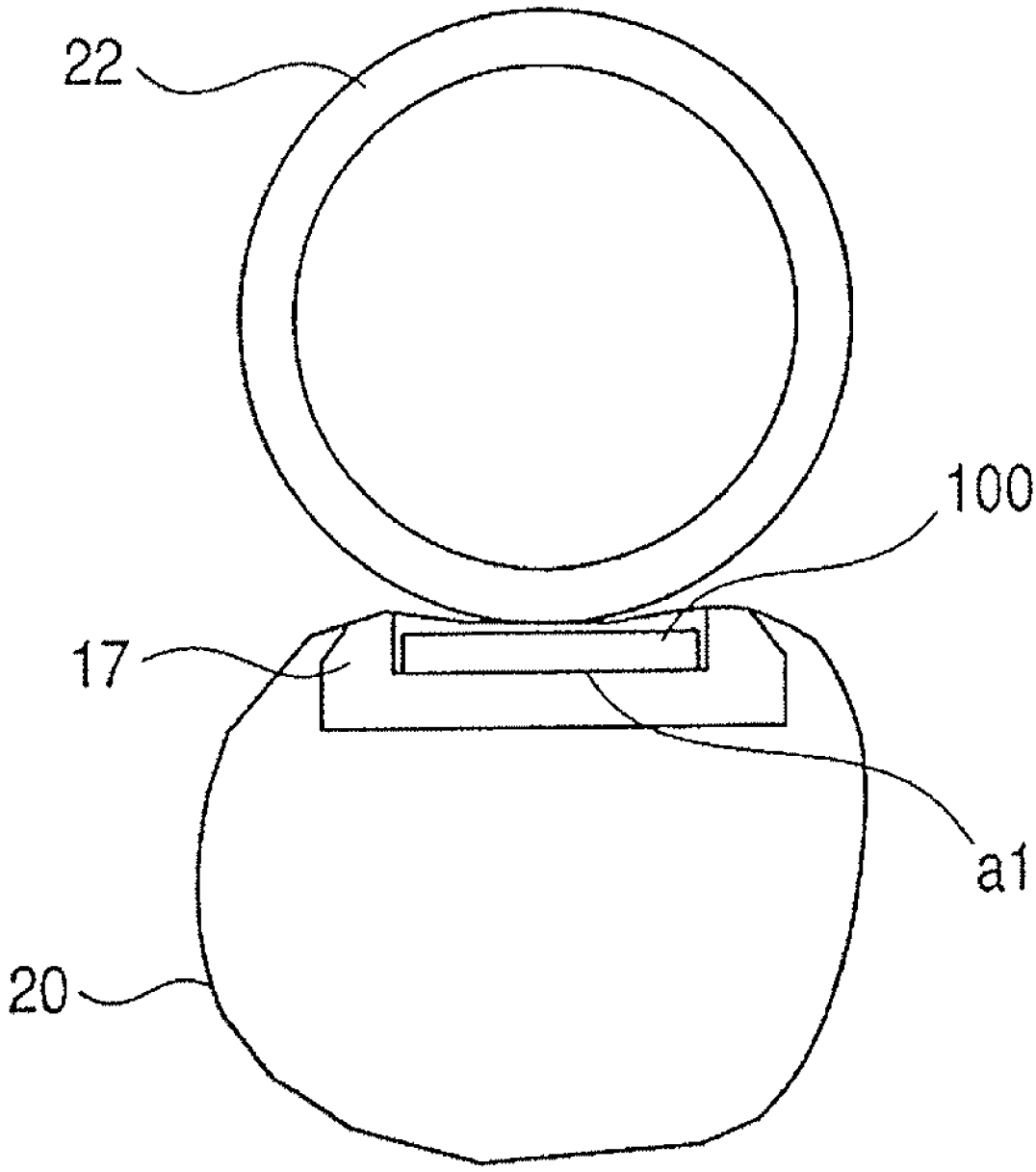
FIG. 2 is a cross sectional view illustrating the positional relationship between the heater holder and the heater in region A in the first embodiment.
Figure 3:
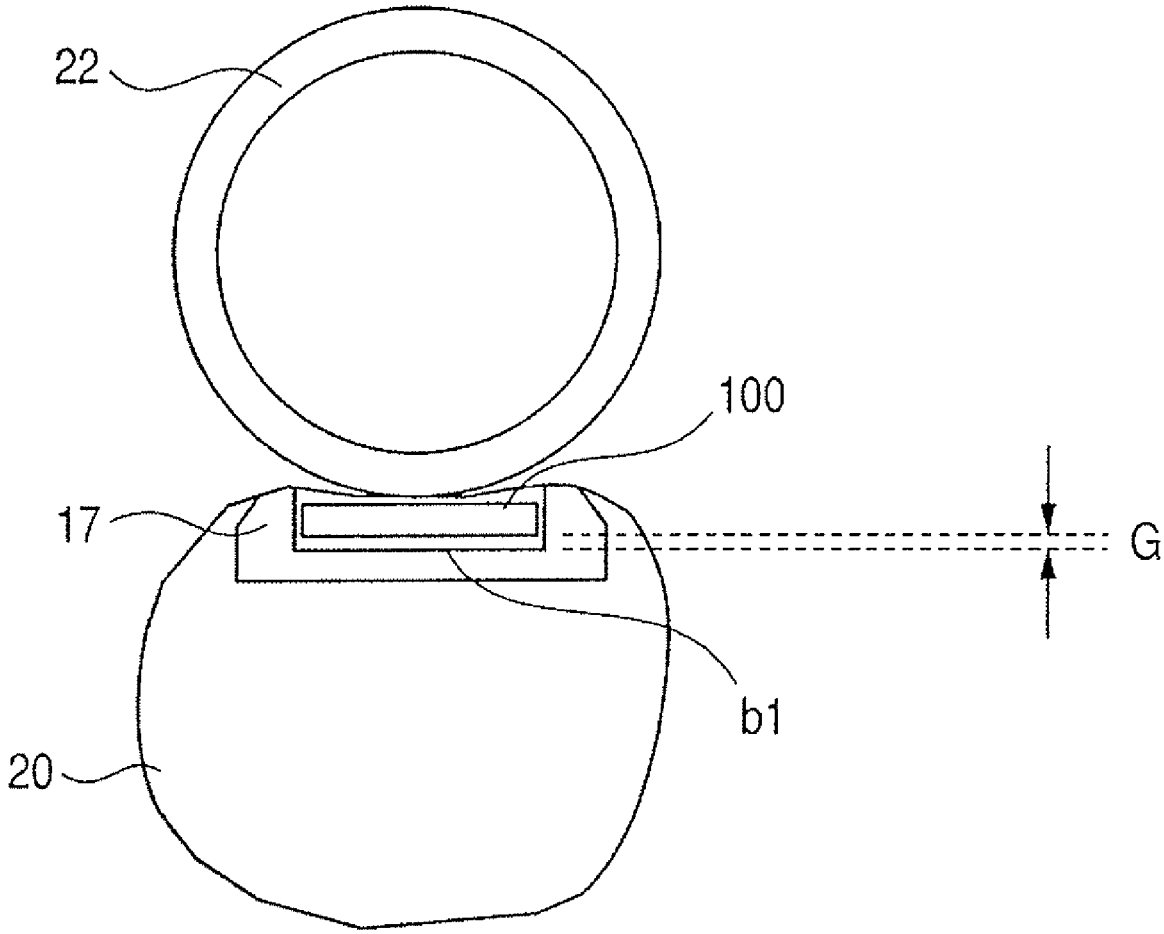
FIG. 3 is a cross sectional view illustrating the positional relationship between the heater holder and the heater in region B in the first embodiment.
Figure 4:
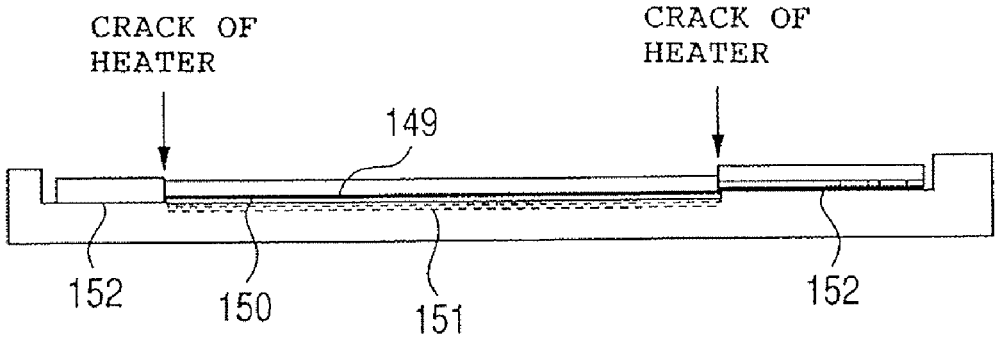
FIG. 4 illustrates cracks of a heater.

FIG. 2 is a cross sectional view of region A in FIG. 1 taken along a plane perpendicular to the heater surface. The heater 100 is supported by the heater holder support surface a1 against the pressurizing force applied by the pressure roller 22 via the fixing belt 20. FIG. 3 is a cross sectional view of region B in FIG. 1 taken along a plane perpendicular to the longitudinal direction. The heater 100 and the heater holder 17 are not in contact with each other and designed to have a gap G of 0.7 mm between the backside surface of the heater and the opposed surface b1 of the heater holder 17. In other words, the surface of the heater holder 17 that is opposed to the surface of the heater 100 that faces away from the fixing nip portion has the seating surface area a1 that is in contact with the heater 100 and the concaved portion areas b1 that are provided closer to the end portions with respect to the longitudinal direction than the seating surface area a1 is. The concaved portion areas b1 are not in contact with the heater 100 all over the length along the shorter side of the heater 100 (i.e. along the recording material conveyance direction).

The above mentioned design value should be changed in accordance with the allowable temperature limit of the heater holder, the quantity of heat generation by the heater, the pressurizing force applied by the pressure roller and other factors.

As described above, in this embodiment, the length of the pressure roller 22 (i.e. the length of the nip portion) and the length of the seating surface a1 of the heater holder 17 are substantially equal to each other. Accordingly, when the heater 100 is held between the heater holder 17 and the pressuring roller 22, a load that flexes the heater 100 is not applied on it.

(Power Supply Circuit, Power Control Circuit)

Figure 9:
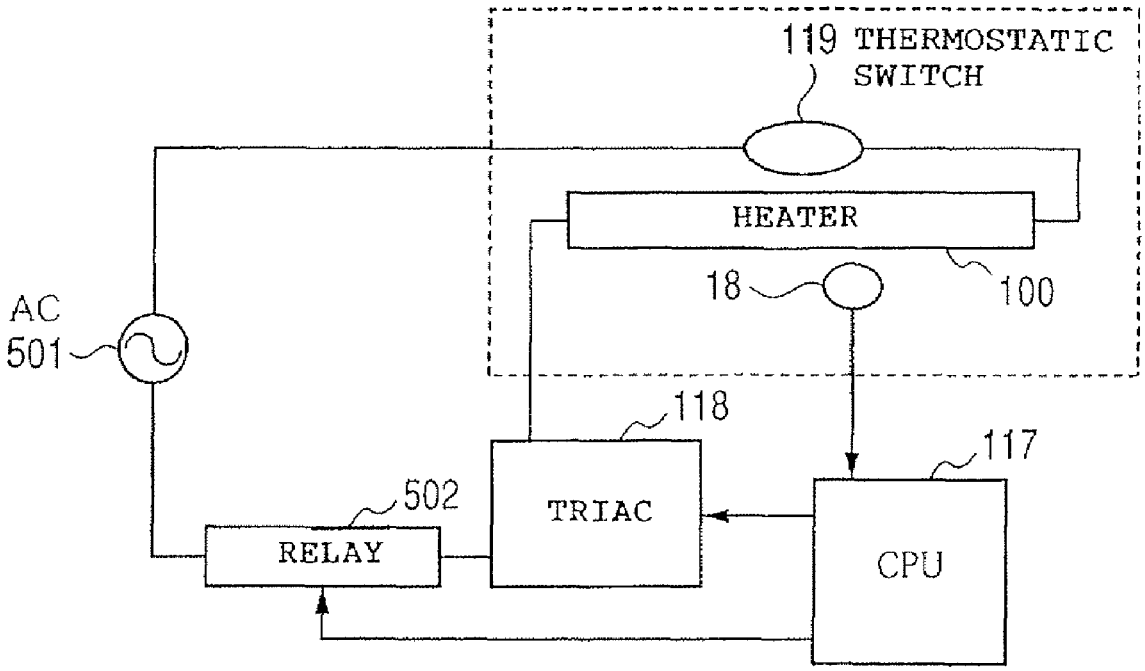
FIG. 9 is a diagram showing an electric power control circuit in the first embodiment.

A power supply circuit for the heater 100 and a power control circuit will be described with reference to FIG. 9.

The power supply circuit (AC circuit) is composed of an AC power source 501, a relay 502, a triac 118, the heater 100 and the thermostatic switch 119 serving as a safety device that are connected in series.

The power control circuit (DC circuit) is composed of the CPU 117 and the thermistor 18 that detects the temperature of the fixing belt 20 etc. The CPU 117 determines the electric power to be supplied to the heater 100 based on temperature information from the thermistor 18 that detects the temperature of the fixing belt 20, and controls the triac 118. In the fixing device according to this embodiment, the CPU 117 is adapted to control the triac 118 in such a way that the temperature detected by the thermistor 18 is kept at a control target temperature (set temperature).

The relay 502 is adapted to operate in response to a command signal from the CPU 117 when, for example, an abnormal temperature rise of the heater 100 occurs, to shut down the power supply circuit.

The thermostatic switch 119 is adapted to operate in response to an excessive temperature rise of the heater 100 to shut down the power supply circuit.

(Excessive Power Supply Test)

We conducted an excessive power supply test on this fixing apparatus. Stress acting on the heater 100 was examined by this test. The excessive power supply test was conducted under the condition in which the temperature of the heater 100 would rise most rapidly. Specifically, the triac 118 in the control circuit was broken intentionally to make it conductive in both directions, and the relay 502 was short-circuited. Under this condition, power was supplied from the AC power source 501 so that the maximum power was continuously supplied to the heater. The voltage applied was 140 volts, which was higher by 10% than the rated voltage of 127 volts in the highest voltage area among the 120 V areas. The temperature of the ambient in which the fixing device was placed was 25° C. and the humidity was 50%. During the experiment, the fixing device was not rotated but kept in a stationary state. The reason why the experiment was conducted while keeping the fixing device stationary is that in the stationary state, the energy supplied to the heater 100 is hardly removed by the pressure roller 22, and the fixing device is damaged more greatly in the stationary state than in the rotating state.

(Result of Excessive Power Supply Test)

We conducted the excessive power supply test five times under the above described condition, but cracks of the heater were not formed in any of the tests. This means that even when abnormal heat generation by the heater 100 caused softening of the seating surface a1 of the heater holder 17 thereby causing sinking of the heater 100 into the heater holder 17, little stress was exerted on the substrate 101 of the heater 100.

As shown in FIG. 1, in the fixing device according to this embodiment, the length of the pressure roller 22 (i.e. the length of the nip portion), the length of the heat generation resistive member 102 and the length of the seating surface a1 are substantially equal to one another, and these areas are substantially completely overlap. Accordingly, even if the seating surface a1 was softened, the level of the seating surface a1 after softening was substantially the same as the level of the opposed surface b1 of the heater holder 17. For this reason, excessive stress did not act on the heater 100.

In addition, the thermostatic switch 119 worked to stop the power supply to the heater 100 before the portion of the heater 100 in which the heat generation resistive member 102 was provided sank into the seating surface a1 of the heater holder 17 due to continuous abnormal heat generation by the heater 100. This prevented cracking of the heater 100.

In connection with this, we measured the time from the start of the power supply to the heater to the start of the operation of the thermostatic switch 119, or the time from the start of the power supply to the heater until the power supply to the heater 100 was shut down. The time was 6.0 seconds at maximum, 5.2 seconds at minimum and 5.5 seconds on average.

In addition we also conducted, three times, the test of intentionally short-circuiting the thermostatic switch 119 and supplying excessive power to the heater in the state in which the heater was mounted on the heater holder according to the present invention. The result was that in any case, leakage occurred in the heat generation resistive member 102 and the circuit was opened immediately after that, before cracking of the heater. In other words, since the time until the cracking of the heater was elongated by the use of the heater holder according to this embodiment, leakage occurred prior to cracking of the heater. The times from the start of the power supply to the heater until the circuit was opened in the respective cases were 8.4 seconds, 7.9 seconds and 8.0 seconds, namely 8.1 seconds on average. From this follows that in the fixing device according to this embodiment, even under the most adverse condition in terms of cracking of the heater, the thermostatic switch starts to work approximately 2.6 seconds (8.1 seconds minus 5.5 seconds) before cracking of the heater or the aforementioned leakage (in the case of this embodiment, before the leakage occurred). This means that in the fixing device according to this embodiment, it is highly likely that the thermostatic switch 119 works before the cracking of the heater or the leakage occurs, and sufficient safety is ensured.

COMPARATIVE EXAMPLE 1

Figure 10:
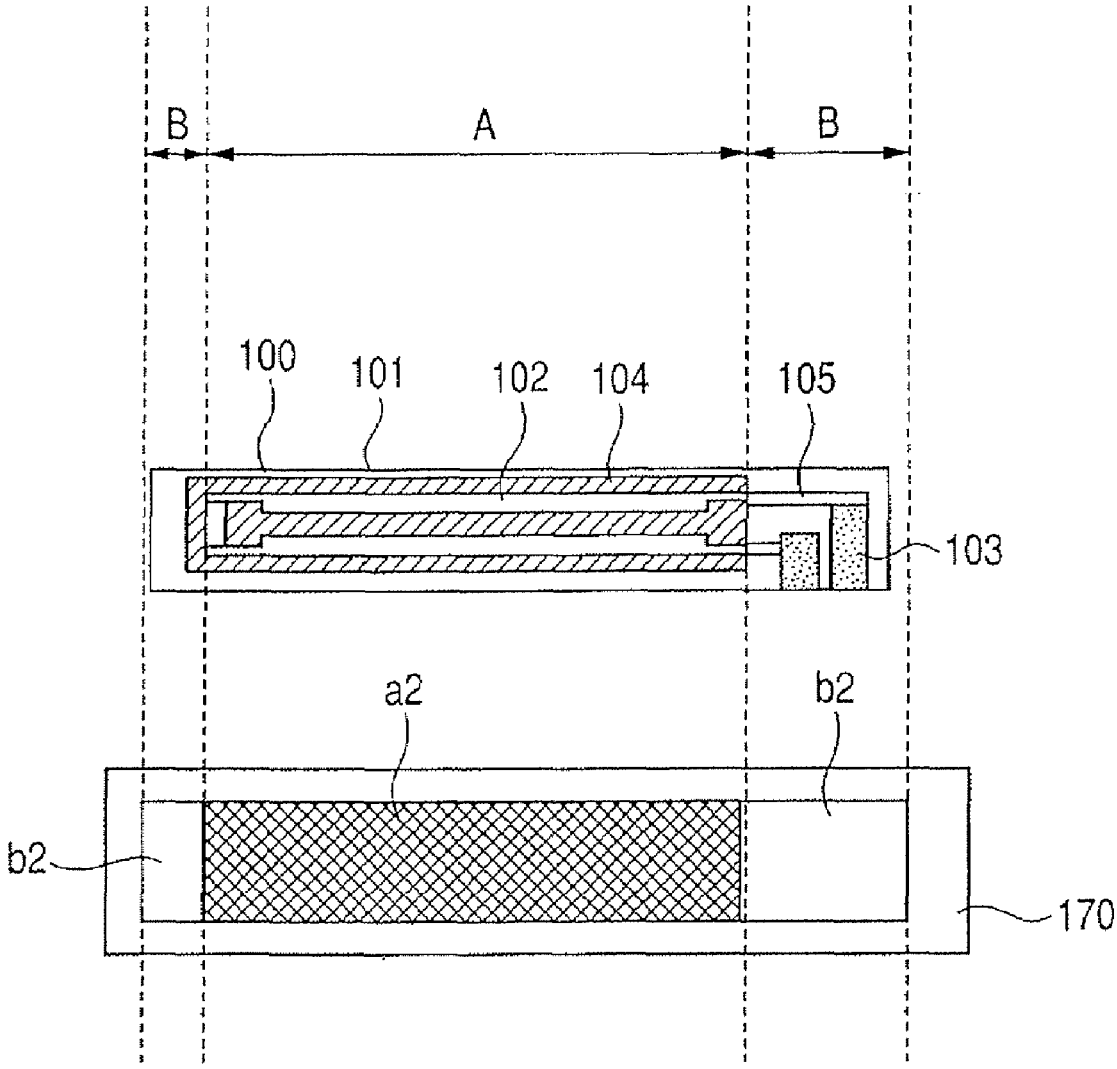
FIG. 10 illustrates the positional relationship along the longitudinal direction between a heater holder and a heater in comparative example 1.

FIG. 10 shows the positional relationship of the heater holder 170 and the heater 100 along the longitudinal direction in a comparative example.

The heater used was the same as that in the embodiment. In the heater holder 170 in this comparative example, the heater holder support surface b2 was in contact with the backside of the heater even in the longitudinal regions B in which the heat generation resistive member 102 was not provided.

We set this heater holder 170 in the fixing device same as the first embodiment, and conducted the excessive power supply test five times in a similar manner as the test for the first embodiment. The result was that in all the cases, the thermostatic switch worked in 5.5 seconds on average before cracking of the heater as with the first embodiment.

Furthermore, in the excessive power supply test, in order to measure the time until cracking of the heater 100 we intentionally short-circuited the thermostatic switch 119 and conducted, three times, the test of continuously supplying power until the heater 100 cracked. The times until the heater 100 cracked in the respective cases were 7.1 seconds, 6.7 seconds and 6.4 seconds, namely 6.7 seconds on average. This means that the thermostatic switch worked prior to the cracking of the heater 100, and safety was ensured. However, the margin was as small as 1.2 seconds (6.7 seconds minus 5.5 seconds). The portions at which cracks occurred were boundary portions between the region A in which the heat generation resistive member 102 was provided and the region B in which the heat generation resistive member 102 was not provided.

As per the above, by using the heater holder 17 according to the first embodiment, it is possible not only to prevent cracking of the heater but also to ensure a safety time margin 1.4 seconds (2.6 seconds minus 1.2 seconds) longer than in the case in which the heater holder 170 according to the comparative example is used.

Figure 11:
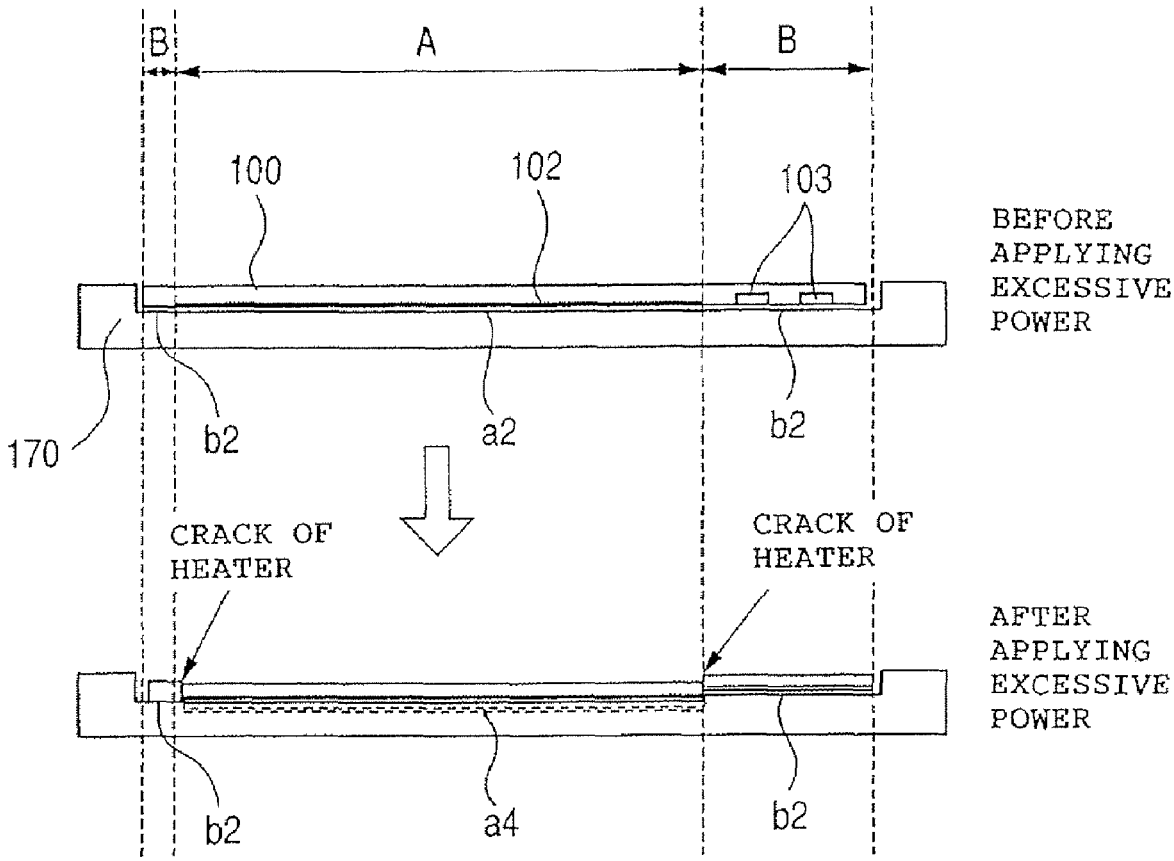
FIG. 11 illustrates the shape of the heater holder before and after an excessive power supply test in comparative example 1.

FIG. 11 shows the shape of the heater holder 170 before and after the excessive power supply test in a comparative manner. Inspection of the heater holder 170 of the comparative example after the excessive power supply test showed that the seating surface a2 of the heater holder was melted. The reason for this is that when a large amount of power is continuously supplied, the temperature of the heater support surface a2 of the heater holder 170 exceeds the allowable temperature limit due to excessive heat generation in the region of the heat generation resistive member 102 with respect to the longitudinal direction of the heater 100. On the other hand, the opposed surface b2 of the heater holder substantially remained unmelted and in its original shape. The reason for this is that in the region of the heater in which the heat generation resistive member is not provided or the region in which the conductor pattern 105 and the electrodes 103 are provided, a large amount of heat is not generated when a large amount of power is continuously supplied, and the temperature of the heater holder does not exceed the allowable temperature limit.

In all the cases, the heater cracked, as indicated by arrows in FIG. 11, in the boundary region between the region A with respect to the longitudinal direction of the heater in which the heat generation resistive member 102 was provided and the region B with respect to the longitudinal direction in which the heat generation resistive member was not provided. When the seating surface a2 of the heater holder 170 melts, the heater 100 is thrust toward the heater holder 170 by the pressurizing force applied by the pressure roller 22, and a difference in level is generated between the melted surface a4 of the heater holder and the heater support surface b2. Consequently, concentration of stress on the heater 100 occurs at this level difference, which causes cracking of the heater.

Similar inspection of the heater holder 17 according to the embodiment after the excessive power supply test showed that the support surface a1 of the heater holder was melted.

Figure 12:
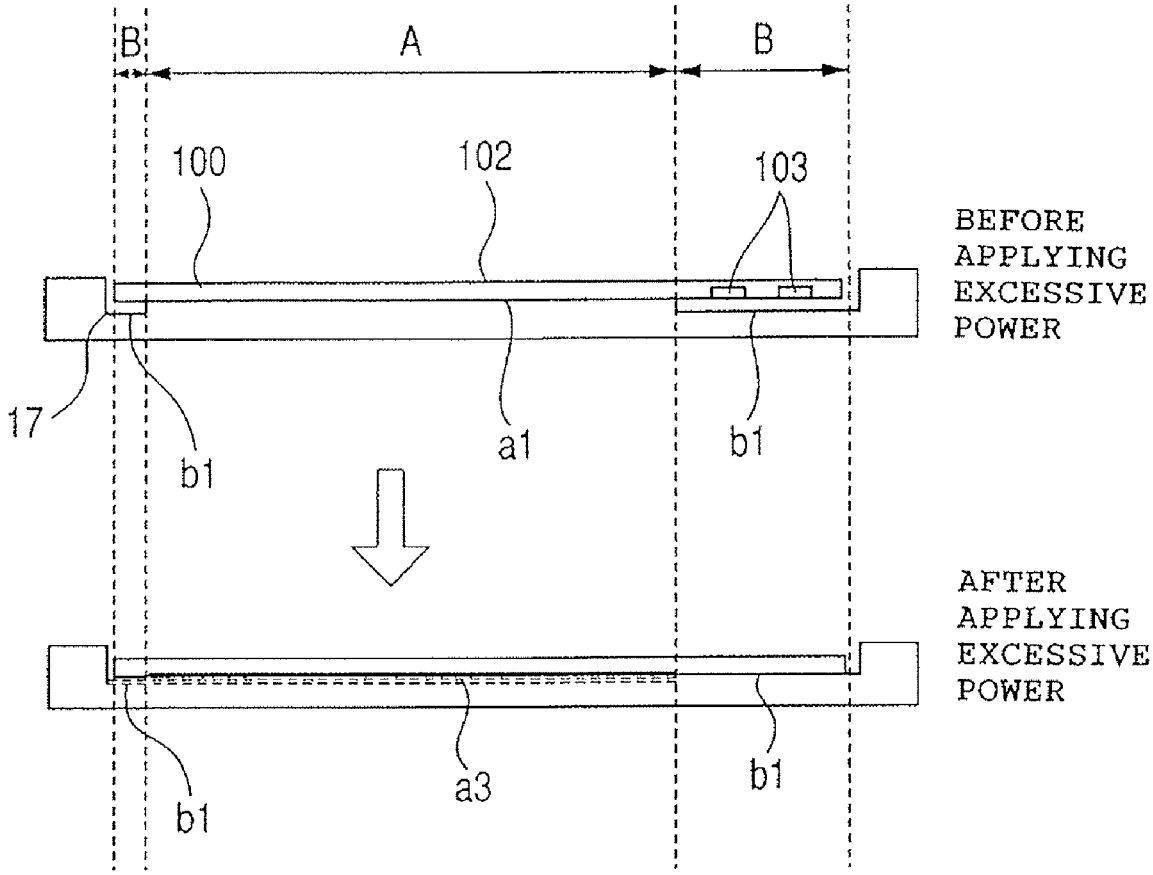
FIG. 12 illustrates the shape of the heater holder before and after an excessive power supply test in the first embodiment.

FIG. 12 shows the shape of the heater holder 17 before and after the excessive power supply test in a comparative manner. Reference sign a3 designates the melted surface of the heater holder after the melting of the seating surface a1, and reference sign b1 designates the surface that is opposed to the region with respect to the longitudinal direction of the heater in which the heat generation resistive member is not provided. Cracking of the heater did not occur in this case contrary to the comparative example.

In this embodiment, a certain space (or gap G in FIG. 3) is provided between the backside surface of the heater and surface b1 of the heater holder as shown in FIG. 12. Thus, when the support surface a1 melts, and the melted surface a3 of the heater holder is pressed down into the heater holder, the melted surface a3 and the heater support surface b1 becomes substantially flush with each other, and there is no difference in level between the melted surface a3 and the support surface b1. Consequently, concentration of stress at the boundary of longitudinal region A and longitudinal region B, which occurred in the comparative example, is prevented, and no cracking of the heater occurs.

As per the above, by using the heater holder 17 according to the first embodiment, it is possible to prevent cracking of the heater even when the fixing device becomes uncontrollable and a large amount of power is continuously supplied to the heater. Thus, it is possible to provide a fixing device that is superior in safety and advantageous from the viewpoint of recycling of parts. In addition, it is possible to prevent the situation that a sufficient space cannot be provided between the portion to which the primary voltage is applied through a thermistor or the like provided in the heater and the secondary circuit or the ground portion, which may cause in some cases breakage of the secondary circuit to incur an additional repair cost.

Second Embodiment

The second embodiment is characterized by the use of a heater holder 99 having a shape that is different from that of the first embodiment. The components used in the fixing device other than the heater holder are the same as those in the first embodiment.

Figure 14:
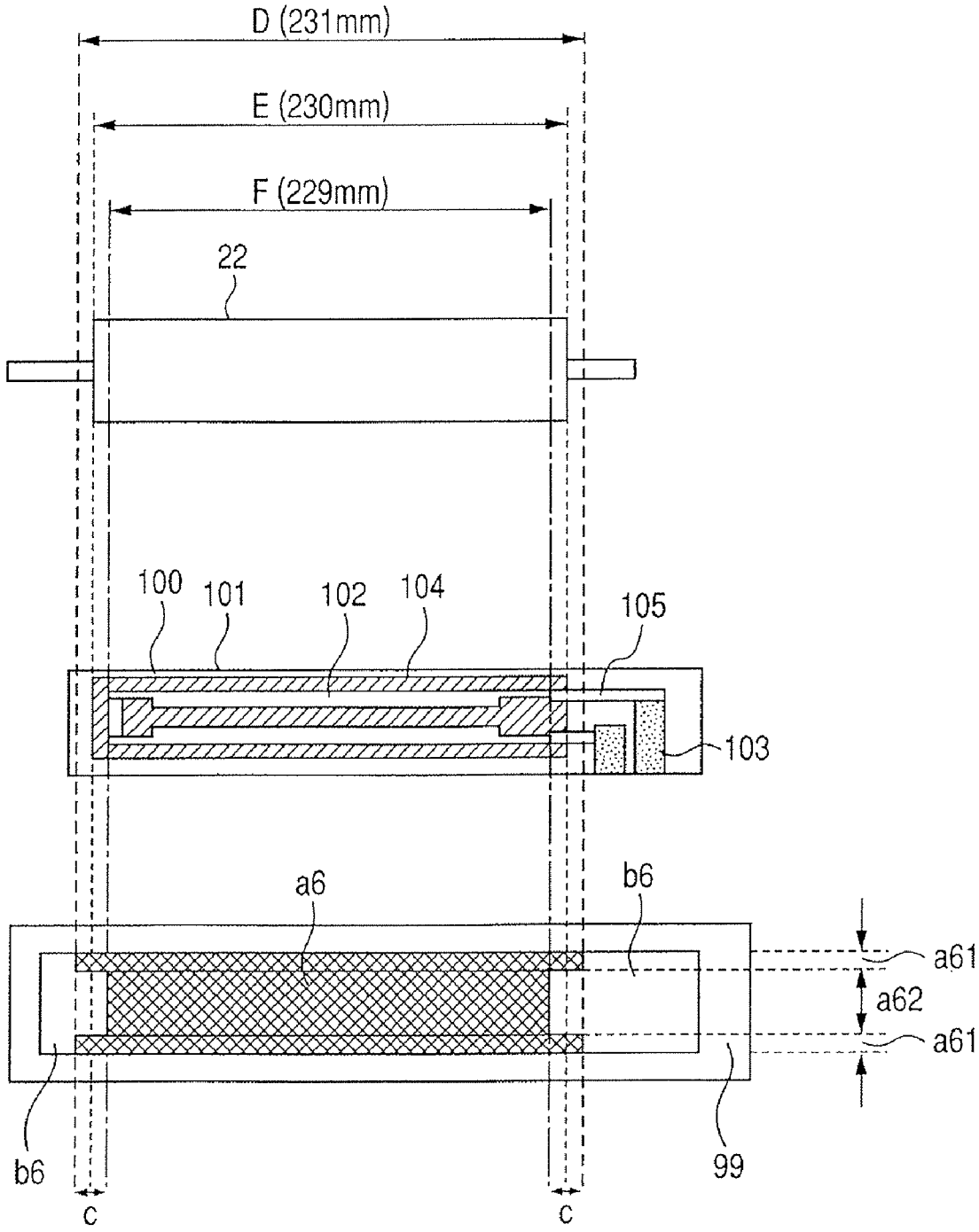
FIG. 14 illustrates the positional relationship along the longitudinal direction among a heater holder, a heater and a pressure roller in a second embodiment of the present invention.
Figure 18:
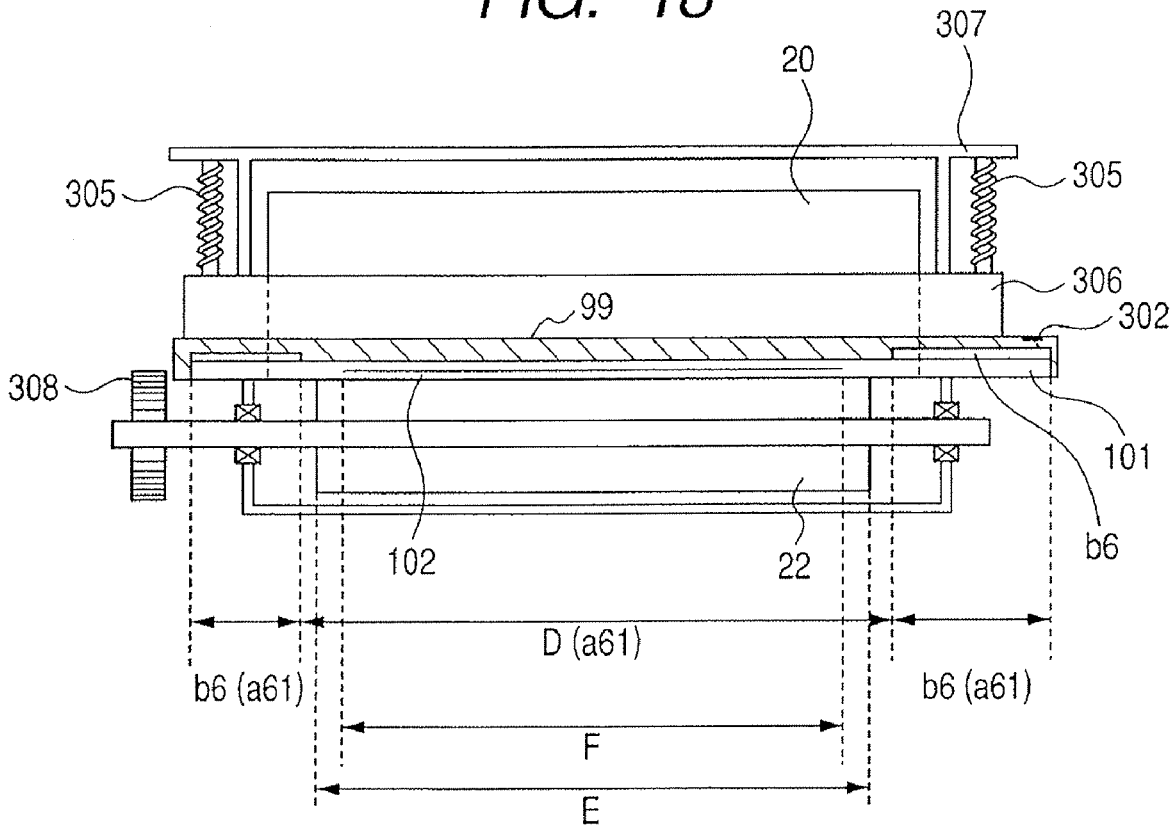
FIG. 18 is a cross sectional view along the longitudinal direction of the fixing device according to the second embodiment.

FIG. 14 illustrates the positional relationship, with respect to the longitudinal direction, of the heater holder 99, the heater 100 and the pressure roller 22 in this embodiment. FIG. 18 is a cross sectional view along the longitudinal direction of the fixing device according to this embodiment. As shown in FIG. 18, the fixing device has a frame 307, a metal stay 306 and springs 305 set between the frame 307 and the stay 306 for applying a pressure to the fixing nip portion. These parts constitute a pressurizing mechanism. The stay 306 extends through the interior of the fixing belt (flexible sleeve) 20 to press the heater holder 99 against the pressure roller 22. To one end of the shaft of the pressure roller 22 is attached a gear 308 for transmitting a driving force to the pressure roller 22.

While the shape of the heater support surface al of the heater holder 17 in the first embodiment is rectangular, a rectangular shape of the heater support surface (seating surface region) a6 of the heater holder 99 in this embodiment is indented at the central portions of its both ends with respect to the longitudinal direction as shown in FIG. 14, and it supports the heater only by support surfaces a61 arranged in the upstream and downstream portions with respect to the recording material conveyance direction thereof. To put it in another way, in this embodiment, region a62 (second region) of the support surface a6 is shorter than region a61 (first region) with respect to the longitudinal direction of the heater holder (the difference between the first region and the second region is indicated as region c in FIG. 14). The level of region a61 is a little higher than the level of region a62. Accordingly, region a62 of the heater supporting surface (seating surface region) a6 does not come in contact with the heater. Region a62 is provided in order to optimize the distribution of the thickness of the air layer (serving as heat insulation layer) between the heater 100 and the heater holder 99, thereby optimizing the temperature distribution of the heater 100. Alternatively, the level of region a61 and the level of region a62 may be designed to be the same to allow region a62 (second region) also to be in contact with the heater 100. Incidentally, FIG. 18 is a cross sectional view of the fixing apparatus taken along the longitudinal direction thereof in region a61.

As with the heater holder 17 in the first embodiment, opposed surfaces (concaved portion areas) b6 of the heater holder that are not contact with the backside surface of the heater are provided outside the heater support surface a6 with respect to the longitudinal direction over the length of the shorter side of the heater. In region b6 of the heater holder 99 is provided a connector attachment portion 302 to which a power feeding connector 301 to be connected to the electrodes 103 of the heater 100 is attached. The distance between the opposed surface b6 of the heater holder and the backside surface of the heater is designed to be 0.7 mm. The distance between region a62 (second region) and the backside surface of the heater is designed to be 0.2 mm. In this embodiment, the length of the support surface a6 is 231 mm, the length of the pressure roller is 230 mm and the length of the heat generation resistive member is 229 mm, which satisfy the following condition.

(length of support surface D)≧(length of pressure roller E)≧(length of heat generation resistive member F) (1)

Thus, the region E of the nip portion (the region of the pressure roller) is included in the first region a61 (region D) and the region F of the heat generation resistive member is included in the region E of the nip portion (the region of the pressure roller), with respect to the longitudinal direction of the fixing device.

The intention in designing region E to be included in region D, in other words, the intention in designing region D to be larger than region E is to make the area over which the heater 100 is supported larger than the area over which the heater 100 receives pressure from the pressure roller 22 so that stress is unlikely to be exerted on the heater 100 (or the heater substrate 101). If region F extends beyond region E, heat generated by the heat generation resistive member 102 does not flow into the pressure roller 22 in the portion beyond region E, but stays in the substrate 101 of the heater to raise the temperature of the substrate 101 high. On the other hand, in the portion within region E, heat is easily transmitted to the pressure roller 22, and the temperature of the substrate 101 of the heater 100 is not likely to become high. This temperature difference generates thermal stress in the heater substrate 101, which makes the possibility of cracking of the heater high even during normal use. In view of this, region F is designed to be included in region E, in this embodiment.

For the above reason, it is necessary that condition (1) presented above be satisfied. According to the design of the first embodiment, the length of support surface D, the length of pressure roller E and the length of heat generation resistive member F are equal to one another (length D=length E=length F), which relationship satisfies condition (1). However, due to presence of tolerance of parts, manufacturing variations and heat expansion of parts, condition (1) is not always satisfied. In the second embodiment, tolerance of parts, manufacturing variations and heat expansion of parts have been taken into consideration, so that condition (1) is satisfied in any combination of parts and at any temperature to eliminate cracking of the heater during normal use.

However, cracking of the heater sometimes cannot be prevented successfully only by satisfying condition (1). In the structure in which the condition "region D>region E>region F" is satisfied as is the case with this embodiment, there is a possibility that the portion (region C) of the heater support surface a6 between region D and region F remains without being softened by the heat of the heater at the time of abnormal temperature rise. In view of this, in this embodiment, region a62 (second region) of the support surface a6 is designed to be shorter than region a61 (first region) with respect to the longitudinal direction of the holder. By this design, the area of the support surface between region D and region F (region C) (the portion surrounded by regions a61 and region C) is made small, and this portion is softened by heat generated by the heater during abnormal heat generation. Thus, stress exerted on the substrate 101 of the heater 100 can be suppressed.

It is preferred that the second region is included in the region of the heat generation resistive member, with respect to the longitudinal direction. It is also preferred that the distance between one end of the first region and one end of the second region (i.e. the length of region C) along the longitudinal direction be in the range of 0.5 mm to 10 mm.

(Result of Excessive Power Supply Test)

We conducted the excessive power supply test five times in the same manner as the test for the first embodiment. Cracks of the heater 100 were not formed in any of the tests. We measured the time that elapsed until the thermostatic switch 119 became off to shut down power supply to the heater 100. The time was 6.1 seconds at maximum, 5.0 seconds at minimum and 5.5 seconds on average. In addition, we also conducted, three times, the test of intentionally short-circuiting the thermostatic switch 119 and supplying excessive power to the heater in the state in which the heater was mounted on the heater holder according to the present invention. The result was that in any case, the cracking of the heater did not occur, but leakage occurred in the heat generation resistive member and the circuit was opened immediately after that, before cracking of the heater. The times that elapsed until the circuit was opened in the respective cases were 8.2 seconds, 7.7 seconds and 7.8 seconds, namely 7.9 seconds on average. From this follows that in the fixing device according to this embodiment, even under the most adverse condition in terms of cracking of the heater, the cracking of the heater does not occur, and the thermostatic switch 119 starts to work before the leakage occurs by a margin of approximately 2.4 seconds. Therefore it can be said that sufficient safety is ensured.

COMPARATIVE EXAMPLE 2

Figure 15:
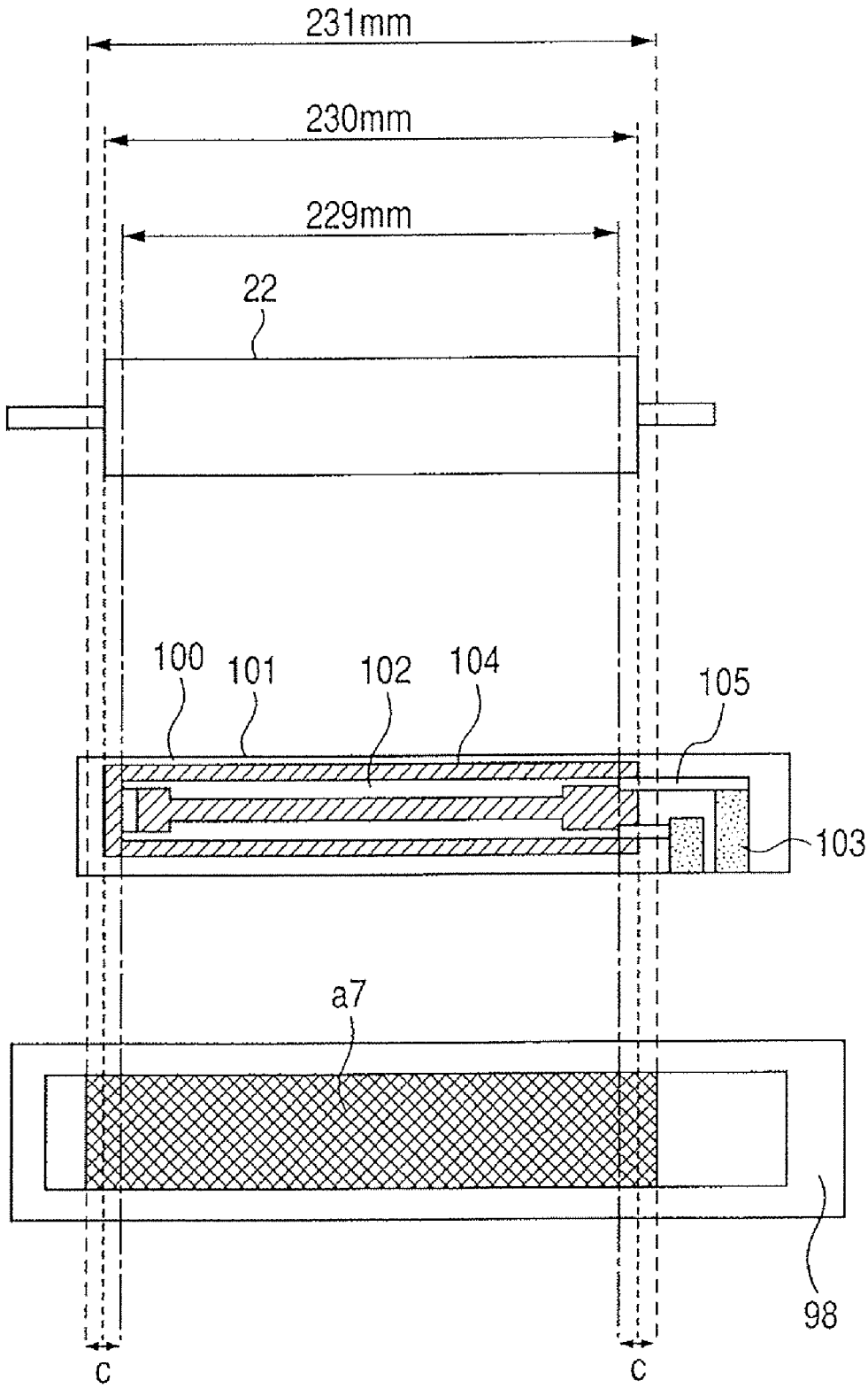
FIG. 15 illustrates the positional relationship along the longitudinal direction among a heater holder, a heater and a pressure roller in comparative example 2.

FIG. 15 shows the positional relationship of the heater holder 98, the heater 100 and the pressure roller 22 along the longitudinal direction in comparative example 2. The heater holder 98 in this comparative example satisfies the condition "region D>region E>region F". However, the shape of the heater holder 98 in region C in FIG. 15 or the differential region of region D and region F is different from the heater holder 99 in the second embodiment. Specifically, indentation at the center of that region is not present in this comparative example, but the heater support surface a7 has a rectangular shape like in the first embodiment.

We set this heater holder 98 on the fixing device and the image forming device same as the first embodiment and conducted excessive power supply test five times in the same manner as the test for the first embodiment. The result was that the thermostatic switch worked in 5.5 seconds on average before the cracking of the heater in all of the tests, as with the test for the first embodiment.

To measure the time until cracking of the heater 101 cracked under excessive power supply, we conducted, three times, the test of intentionally short-circuiting the thermostatic switch 119 and continuously supplying power until the heater 101 cracked. The times that elapsed until the heater 101 cracked in the respective cases were 7.3 seconds, 6.9 seconds and 6.6 seconds, namely 6.9 seconds on average. Namely, although the thermostatic switch worked prior to the cracking of the heater, and safety was ensured, the margin was as small as 1.4 seconds, which was shorter than that in the second embodiment. This means that by the use of the heater holder 99 according to the second embodiment, it is possible not only to prevent the cracking of the heater but also to ensure a safety margin 1 second longer than that in the case where the heater holder 98 of the comparative example is used.

Figure 16:
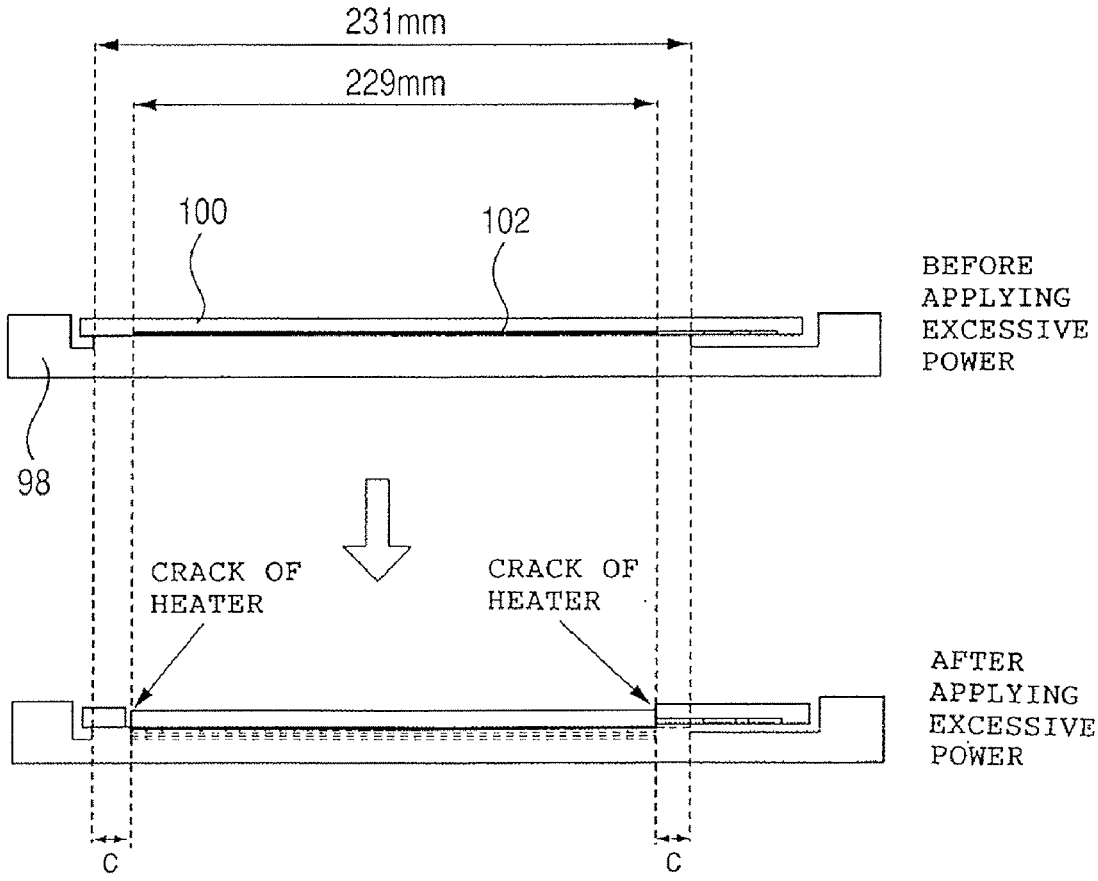
FIG. 16 illustrates the shape of the heater holder before and after an excessive power supply test in comparative example 2.

FIG. 16 illustrates the heater 100 and the heater holder 98 before and after the excessive power supply test. Inspection of the heater holder 98 according to this comparative example after the excessive power supply test showed that in all of the tests, the heater support surface of the heater holder opposed to the heat generation resistive member 102 of the heater was melted. On the other hand, the heater support surface in region C in which the heat generation resistive member is absent remained substantially in its original shape, though only the surface thereof was melted. The reason for this is that in the region in which the heat generation resistive member 102 is absent or in the region in which only the conductor pattern 105 and the electrodes 103 are provided, a large amount of heat is not generated even when a large amount of power is continuously supplied, but the surface is somewhat melted by heat transmitted from the adjacent region in which the heat generation resistive member is provided.

In all the cases, the heater cracked at the positions indicated by arrows in FIG. 16. When the heater holder melts in region F, the heater 100 is thrust toward the heater holder 98 by the pressurizing force applied by the pressure roller 22, and a difference in level is generated between the melted surface of the heater holder and the heater support surface in region C. Consequently, concentration of stress on the heater 100 occurs at this level difference, which causes cracking of the heater.

Figure 17:
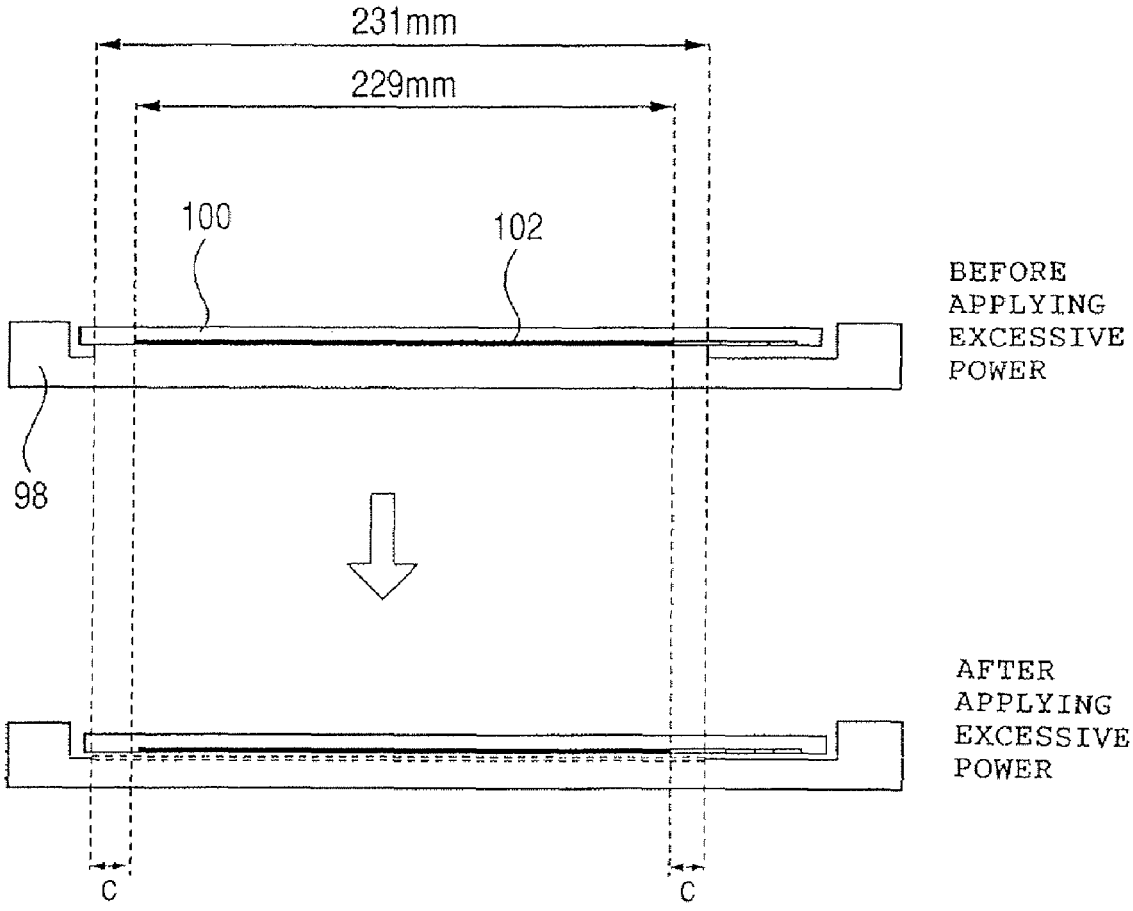
FIG. 17 illustrates the shape of the heater holder before and after an excessive power supply test in the second embodiment.

FIG. 17 shows the heater 100 and the heater holder 99 before and after the excessive power supply test. Similar inspection of the heater holder 99 according to the second embodiment after the excessive power supply test showed that the heater holder was melted in region F in all the cases as with the comparative example. In contrast to the comparative example, melting of the support surface in region C was found. Cracking of the heater did not occur.

In this embodiment, since the heater support surface has central indented portions in region C, the contact area in region C is smaller than the contact area in the comparative example (the portion surrounded by region C and regions a61). Accordingly, the heat flowing into region C from the adjacent heat generation resistive member is likely to concentrate to the support surface to promote the melting of the support surface. When the support surface melts in region C, a difference in level between region C and regions F and b6 is not generated. Thus, concentration of stress on the heater like that occurred in the comparative example is prevented, and the cracking of the heater does not occur.

It has been demonstrated that even in the case where the contact area of the heater support surface in region C is not reduced in a manner like in this embodiment, it is possible to prevent generation of a difference in level between region C and regions F and b6 by using, in region C of the heater support surface, a material that melts easily upon supply of excessive power and is different from the material of the other portions, thereby suppressing concentration of stress on the heater.

As per the above, by using the heater holder 99 according to the second embodiment, it is possible to prevent cracking of the heater in normal use, and even when the fixing device becomes uncontrollable and a large amount of power is continuously supplied to the heater, cracking of the heater can be prevented. Thus, it is possible to provide a fixing device that is superior in safety and advantageous from the viewpoint of recycling of parts. In addition, it is possible to prevent the situation that a sufficient space cannot be provided between the portion to which the primary voltage is applied through a thermistor or the like provided in the heater and the secondary circuit or the ground portion, which may cause in some cases breakage of the secondary circuit to incur an additional repair cost.

Third Embodiment

Figure 19:
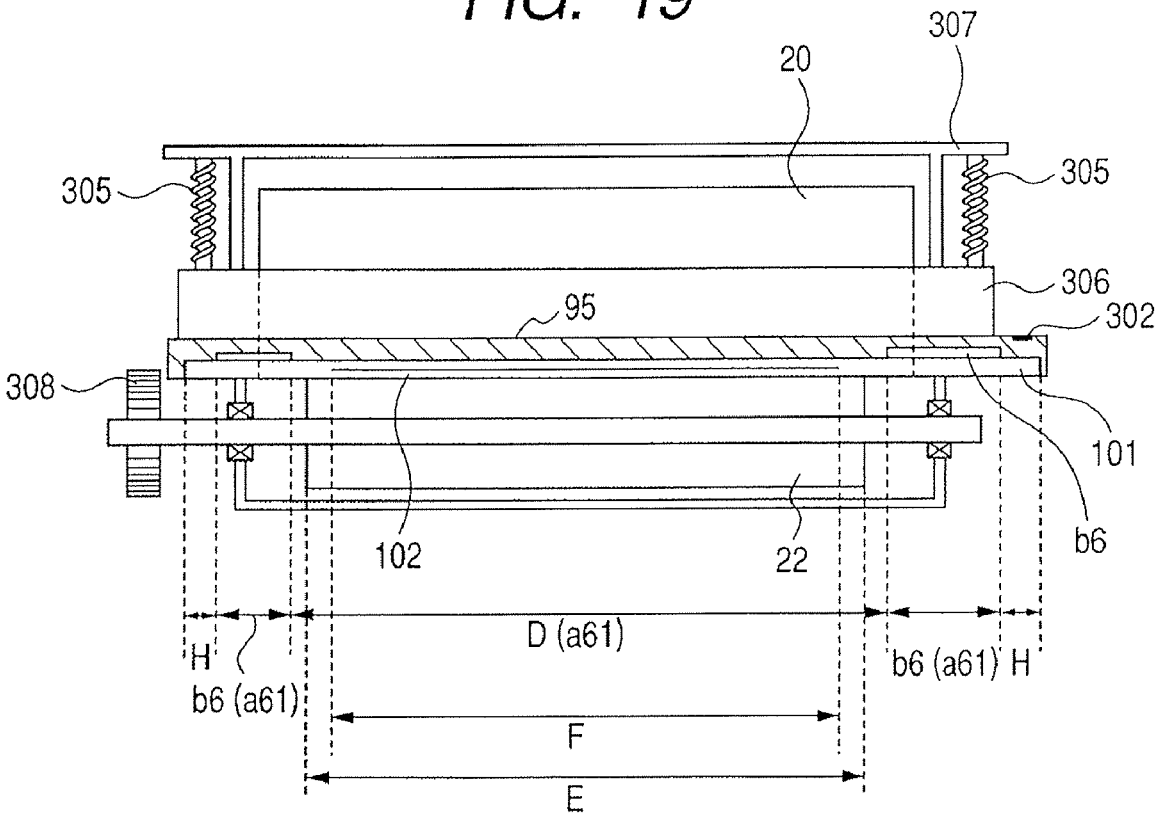
FIG. 19 is a cross sectional view along the longitudinal direction of the fixing device according to a third embodiment.

FIG. 19 shows a third embodiment, which is different from the second embodiment in that seating surfaces (end seating surface areas) H that support the backside surface of the heater are provided at the end portions with respect to the longitudinal direction of the heater holder 95. The structure other than this is the same as that in the second embodiment. Regions designated by b6 are regions in which the heater holder does not support the backside surface of the heater at all. The shape of seating surface a6 is the same as that in the second embodiment.

The third embodiment is advantageous in that the position of the connector is stable, since the connector attachment portion 302 is provided in region H.

In the case of the third embodiment, seating surfaces H melts little even when abnormal heat generation by the heater occurs. However, since seating surfaces H are provided closer to the ends of the heater holder 95 with respect to the longitudinal direction than regions b6 are, even when seating surface a6 melts and a force is exerted on the heater from the pressure roller, warpage of the heater can be suppressed small, and stress acting on the heater can be made small.

Fourth Embodiment

The fourth embodiment is characterized in that use is made of a fixing device that consumes a smaller amount of power and is suitable for high speed image fixing than the fixing device according to the first to the third embodiment.

(Description of Structure of Fixing Apparatus)

Figure 13:
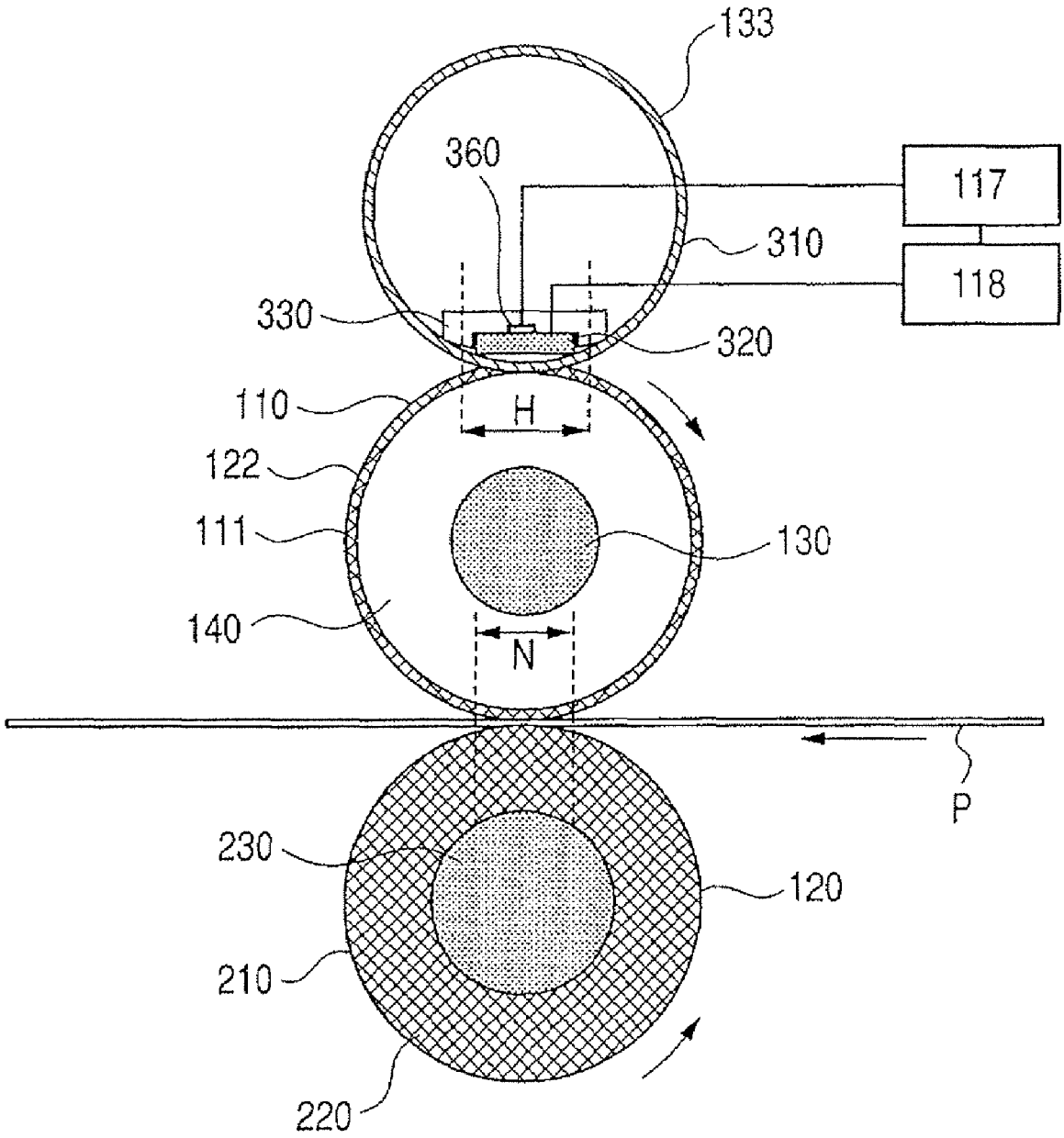
FIG. 13 is a cross sectional view of a fixing device according to a fourth embodiment of the present invention.

FIG. 13 schematically shows the structure of the fixing device according to this embodiment. The fixing device has a heating roller (elastic roller) 110, a pressure roller 120 that forms a nip portion N in cooperation with the heating roller 110 and external heating means 133 for heating the heating roller 110 from the exterior of it. The outer diameter of the heating roller 110 is 25 mm. The roller base 140 of the heating roller 110 is made of a porous ceramic, and a metal core 130 made of aluminum with an outer diameter of 8 mm is adhered to the inner circumference of the roller base 140 using an epoxy resin adhesive. A silicone rubber layer 122 with a thickness of 1 mm is provided on the outer circumference of the roller base 140 as an elastic layer, and a fluororubber layer 111 is provided on the outer circumference of the silicone rubber layer 122 as a releasing layer (surficial layer).

Both ends of the metal core 130 of the heating roller 110 are rotatably supported between side panels of the device by means of bearings, and the heating roller 110 is driven by a driving system (not shown) to rotate in the clockwise direction as indicated by an arrow at a constant circumferential velocity.

The outer diameter of the pressure roller 120 is 25 mm. The pressure roller 120 is a heat-resistant elastic roller composed of a metal core 230 made of aluminum with an outer diameter of 11 mm and a solid silicone rubber layer 220 provided coaxially and integrally on the metal core 230 to form a roller shape. The outer circumference thereof is covered with a PFA tube with a thickness of 30 μm serving as a releasing layer 210. The surface hardness of the pressure roller 120 is 60° (ASKER-C at a load of 500 gf).

The pressure roller 120 is arranged beneath and in parallel with the heating roller 110. Both ends of the metal core 230 are rotatably supported by means of bearings, and the pressure roller 120 is biased by biasing means (not shown) against the bottom surface of the heating roller 110 with a pressurizing force of 25 Kgf (245 N) to form a press contact nip portion (or fixing nip portion ) N.

The pressure roller 120 is driven by rotation of the heating roller 110 to rotate, and when a recording material P is introduced into the nip portion N, holds and conveys the recording material P in cooperation with the heating roller 110. The external heating means 133 is a heater unit (heat supply unit) of a film heating type. The external heating means 133 includes an endless (i.e. cylindrical) heat-resistant film (or a flexible sleeve) 310 having an outer diameter of 20 mm and a thickness of 60 μm and a substrate 320 made of aluminum nitride with a thickness of 0.7 mm. The heater holder 330 is made of a liquid crystal polymer (Zenite 7755M (registered trademark) sold by DuPont) as is the case with the first to the third embodiments. The shape of the heater holder 330 is substantially the same as that in any one of the first to the third embodiments. In the case where the heater holder 330 is the same as that in the first embodiment, the region A with respect to the longitudinal direction of the heater in which the heat generation resistive member is provided is supported by a heater support surface a1, and an opposed surface b1 that is opposed to the other regions B with respect to the longitudinal direction of the heater in which the heat generation resistive member is not provided is designed to be lower than the support surface a1 so that a gap of 0.8 mm is formed between the backside surface of the heater and the opposed surface b1.

The endless film 310 is loosely attached on the heater holder 330 with the heater 320. To enhance quick start properties by making the heat capacity small, a polyimide film with a thickness of 30 μm is used as the film 310. The outer circumferential surface thereof is coated with PTFE. The heater unit 133 serving as external heating means is composed of the above described film 310, the heater 320, a film guide member 330 and other parts. The heater 320 side of the heater unit 133 is opposed to the heating roller 110 and pressed against it by a predetermined pressing force by biasing means that is not shown in the drawings. The film 310 rotates with the rotation of the heating roller 110 while sliding on the heater 320 in the counterclockwise direction indicated by an arrow in FIG. 13 at a circumferential velocity substantially the same as the circumferential velocity of the rotating heating roller 110.

A thermistor 360 is in contact with the backside of the heater 320. The thermistor 360 is adapted to detect the temperature of the heater 320 and connected with a CPU 117. The CPU 117 determines the electric power to be supplied to the heater 320 based on information from the thermistor 113 and controls a triac 118. The electric power determined and controlled by the CPU 117 is supplied to the heater, whereby the heating roller 110 is heated to a predetermined fixing temperature. A recording material P that bears an unfixed toner image is introduced in the nip portion N between the heating roller 110 and the pressure roller 120. The unfixed toner image on the recording material P is fixed by heat while the recording material P is held and conveyed between the rollers.

A thermostatic switch (not shown) that is in contact with the heater 320 is provided as a safety device on the backside of the heater 320. It is provided for the purpose of shutting down power supply to stop the fixing device safely, in case the fixing device becomes uncontrollable, power supply to the heater 320 is not stopped and the temperature of the heater 320 becomes higher than a certain temperature. This structure is characterized by the use of a heat roller 110 with a small heat capacity whose base is a porous ceramic member 130 and the use of a film heating type heater unit having a good heating efficiency as external heating means. Therefore, it is possible to heat the surface of the heating roller 110 quickly to a predetermined temperature during worm-up time and sheet threading time. Therefore, it is possible to shorten the worm-up time and to reduce the power consumption. In addition, thanks to the rigidity of the porous ceramic member 130, a stronger pressurizing force may be applied, as compared to the film heating method. Therefore, it is possible to reduce the heat energy that is needed in fixing, and it is possible to achieve fixing speeds equal to the heat roller method.

The heater holders according to the first to third embodiments may be used in the fixing device according to this embodiment. In that case also, it is possible to prevent cracking of the heater.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-216151, filed Jul. 26, 2005, and Japanese Patent Application No. 2006-202136 filed Jul. 25, 2006, which are hereby incorporated by reference herein in their entirety.

What is claimed is:

1. An image heating apparatus comprising:

a heater having a substrate, a heat generation resistive member provided on said substrate and an electrode provided on said substrate for supplying electric power to said heat generation resistive member;

a holder made of a resin that has a connector attachment portion, provided at an end portion with respect to a longitudinal direction thereof, for attaching a power feeding connector to be connected to said electrode, said holder holding said heater all along its longitudinal direction; and an elastic roller that forms a nip portion in cooperation with said heater, the image heating apparatus heating an image formed on a recording material by said nip portion, wherein said heat generation resistive member of said heater is arranged within the area of said nip portion with respect to the longitudinal direction of said heater, said connector attachment portion of said holder is arranged outside the area of said nip portion, and a surface of said holder that is opposed to a surface of said heater that is opposite to the nip portion side surface thereof includes a seating area that is in contact with said heater and a concaved portion area that is located closer to an end with respect to said longitudinal direction than said seating area is and is not in contact with said heater all along a shorter side direction of said heater.

2. An image heating apparatus according to claim 1, wherein the length of said heat generation resistive member, the length along said longitudinal direction of said seating area of said holder and the length along said longitudinal direction of said nip portion are substantially equal to one another.

3. An image heating apparatus according to claim 1, wherein said seating area includes first areas that are provided at its both ends with respect to said shorter side direction and a second area that is provided between said first areas and is shorter than said first areas in said longitudinal direction, and, in said longitudinal direction, the area of said nip portion is included in said first areas and the area of said heat generation resistive member is included in the area of said nip portion.

4. An image heating apparatus according to claim 3, wherein in said longitudinal direction, said second area is included in the area of said heat generation resistive member.

5. An image heating apparatus according to claim 3, wherein the distance between one end of said first areas and one end of said second area along said longitudinal direction is in the range of 0.5 mm to 10 mm.

6. An image heating apparatus according to claim 3, wherein in a state where said holder is not softened, said first areas are in contact with said heater, and said second area is not in contact with said heater.

7. An image heating apparatus according to claim 1, wherein said holder has an end portion seating surface area that is in contact with said heater, said end portion seating surface area being located closer to the end of said holder than said concaved portion area is.

8. An image heating apparatus according to claim 7, wherein said connector attachment portion is provided on said end portion seating surface area.

9. An image heating apparatus according to claim 1, further comprising a flexible sleeve that rotates with said heater being in contact with its inner circumferential surface, and said nip portion is formed by said heater and said elastic roller with sleeve therebetween.

* * * * *